US011152708B2

(12) United States Patent
Barrera et al.

(10) Patent No.: US 11,152,708 B2
(45) Date of Patent: Oct. 19, 2021

(54) ELECTRONIC DEVICE HANDLE ANTENNAS

(71) Applicant: Apple Inc., Cupertino, CA (US)

(72) Inventors: Joel D. Barrera, San Jose, CA (US); Jerzy S. Guterman, Sunnyvale, CA (US); Mattia Pascolini, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 194 days.

(21) Appl. No.: 16/357,289

(22) Filed: Mar. 18, 2019

(65) Prior Publication Data

US 2020/0303824 A1 Sep. 24, 2020

(51) Int. Cl.

| | |
|---|---|
| ***H01Q 13/10*** | (2006.01) |
| ***H01Q 1/44*** | (2006.01) |
| ***H01Q 1/24*** | (2006.01) |
| ***H01Q 1/22*** | (2006.01) |

(52) U.S. Cl.

CPC ..... *H01Q 13/10* (2013.01); *H01Q 1/244* (2013.01); *H01Q 1/44* (2013.01); *H01Q 1/2258* (2013.01)

(58) Field of Classification Search

CPC ..... H01Q 13/10; H01Q 1/44; H01Q 1/244; H01Q 1/2258; H01Q 13/18

See application file for complete search history.

(56) References Cited

U.S. PATENT DOCUMENTS

| | | | | |
|---|---|---|---|---|
| 6,304,168 | B1 * | 10/2001 | Ohta | B60R 25/246 340/5.72 |
| 6,507,322 | B2 | 1/2003 | Fang et al. | |
| 6,577,228 | B1 * | 6/2003 | Tsuchida | B60R 25/24 340/10.1 |
| 8,489,162 | B1 | 7/2013 | Dou et al. | |
| 9,397,727 | B1 | 7/2016 | Mattsson et al. | |
| 9,666,934 | B2 | 5/2017 | Lombardi et al. | |
| 9,673,511 | B2 | 6/2017 | Lee et al. | |
| 10,243,624 | B2 | 3/2019 | Kim et al. | |
| 2004/0132505 | A1 * | 7/2004 | Leclerc | H01Q 1/362 455/575.1 |
| 2009/0153410 | A1 * | 6/2009 | Chiang | H01Q 13/08 343/702 |
| 2017/0170562 | A1 | 6/2017 | Lee et al. | |
| 2018/0342791 | A1 | 11/2018 | Wu et al. | |
| 2019/0252759 | A1 * | 8/2019 | Bartlett | H01Q 1/44 |
| 2019/0252788 | A1 * | 8/2019 | Kim | H01Q 13/106 |

* cited by examiner

*Primary Examiner* — Renan Luque

(74) *Attorney, Agent, or Firm* — Treyz Law Group, P.C.; Michael H. Lyons; Tianyi He

(57) ABSTRACT

An electronic device such as a desktop computer may have a housing. The housing may include a conductive inner frame, conductive handles coupled to the inner frame, and a conductive outer sleeve over the inner frame. The handles may protrude through openings in the outer sleeve. Conductive plates may be aligned with the openings and attached to the inner frame. The handles may pass through holes in the conductive plates. Slot antennas may be formed in the conductive plates. The slot antennas may each include a high band slot that indirectly feeds a pair of low band slots. The conductive plates and the inner frame may define cavities for the antennas. Multi-band slot antennas may be formed within the handles themselves. The handles may include solid metal with a channel or may include hollow metal structures to accommodate transmission lines for the antennas.

18 Claims, 14 Drawing Sheets

ELECTRONIC DEVICE HANDLE ANTENNAS

BACKGROUND

This relates to electronic devices, and more particularly, to electronic devices with wireless communications circuitry.

Electronic devices are often provided with wireless communications capabilities. An electronic device with wireless communications capabilities has wireless communications circuitry with one or more antennas. Wireless transceiver circuitry in the wireless communications circuitry uses the antennas to transmit and receive radio-frequency signals.

It can be challenging to form a satisfactory antenna for an electronic device. If care is not taken, the antenna may not perform satisfactorily, may be overly complex to manufacture, or may be difficult to integrate into a device.

SUMMARY

An electronic device such as a desktop computer may have a housing. The housing may have a conductive inner frame and a conductive outer sleeve mounted over the conductive inner frame. The conductive outer sleeve may have first and second openings. The electronic device may have first and second electronic device handles. The first handle may be coupled to the conductive inner frame through the first opening and the second handle may be coupled to the conductive inner frame through the second opening. Conductive plates may be mounted within the conductive outer sleeve in alignment with the first and second openings. Each conductive plate may include a pair of holes that pass a respective one of the handles.

The conductive plate may include a central portion that lies flush with an exterior surface of the conductive outer sleeve and a lip that extends around a periphery of the central portion. The central portion and the lip may lie within separate parallel planes. The central portion may be separated from the conductive outer sleeve by a ring-shaped gap that is filled with a dielectric gasket. Each conductive plate may be used to form at least two antennas. Each antenna may include a high band slot element in the central portion and a pair of low band slot elements in the lip. An antenna feed may be coupled to the central portion across the high band slot element. The high band slot element may indirectly feed the low band slot elements. The low band slot elements may radiate in a first frequency band (e.g., a 2.4 GHz wireless local area network band) through the dielectric gasket. The high band slot element may radiate in a second frequency band (e.g., a 5 GHz wireless local area network band). An interposer printed circuit board may be used to facilitate coupling between a radio-frequency transmission line and the antenna feed. The conductive plate and the conductive inner frame may define the edges of a dielectric-filled cavity that optimizes the efficiency of the antenna.

If desired, the handle may be formed from solid conductive material. A slot element for an antenna may be formed within the solid conductive material. An antenna feed may be coupled to the handle across the slot element. A channel may be formed in the solid conductive material. A radio-frequency transmission line may lie within the channel and may be coupled to the antenna feed. In another suitable arrangement, the handle may include first and second conductive structures that define an interior cavity of the handle. The first and second conductive structures may be separated by a slot element for an antenna. An antenna feed may be coupled across the slot element. A printed circuit board may be mounted to the first and second conductive structures within the interior cavity using conductive screws.

DETAILED DESCRIPTION

Figure 1:
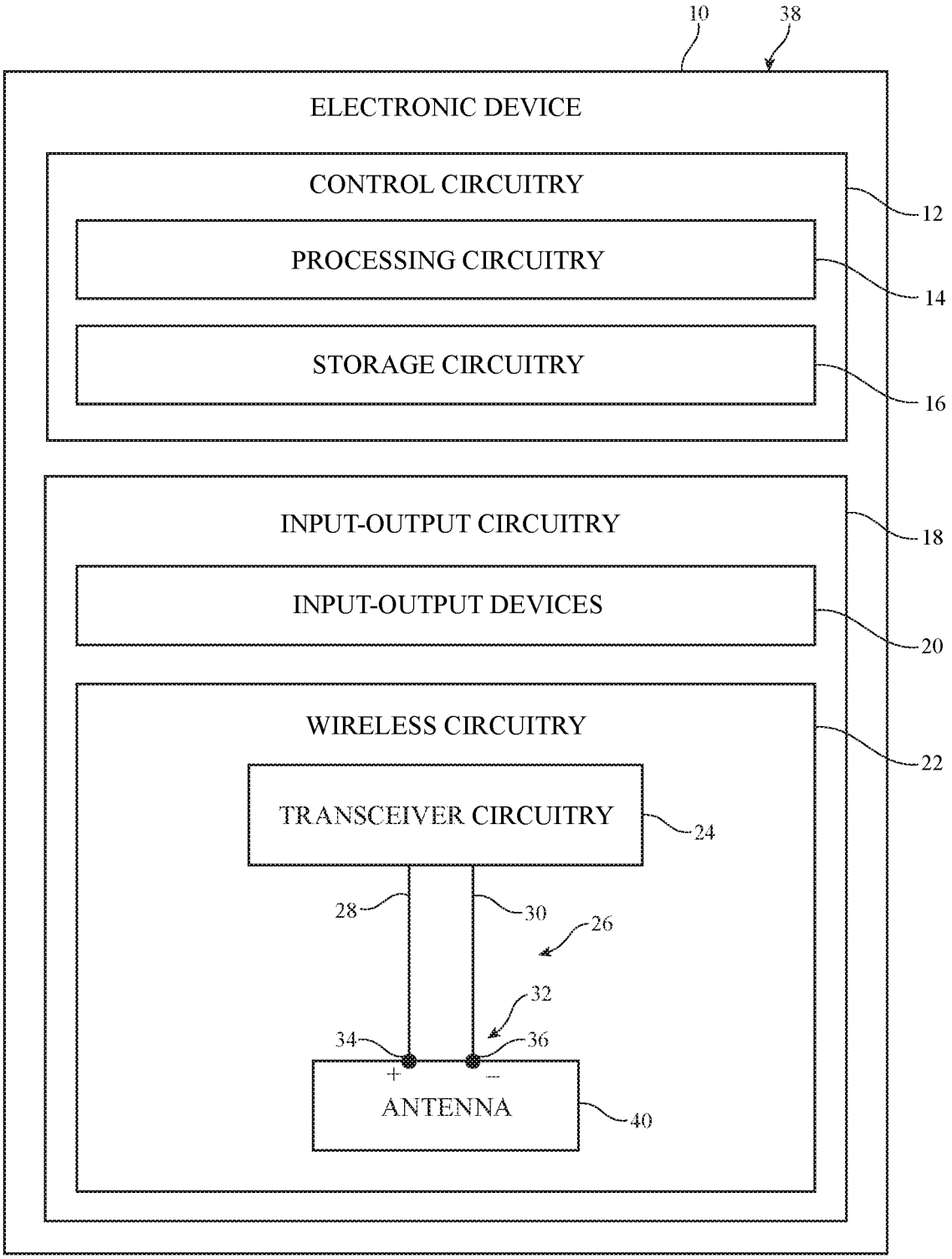
FIG. 1 is a schematic diagram of an illustrative electronic device in accordance with some embodiments.

An electronic device such as electronic device 10 of FIG. 1 may be provided with wireless circuitry. The wireless circuitry may include antennas such as wireless local area network antennas or other antennas. Electronic device 10 may be a computing device such as a laptop computer, a desktop computer, a computer monitor containing an embedded computer, a tablet computer, a cellular telephone, a media player, or other handheld or portable electronic device, a smaller device such as a wristwatch device, a pendant device, a headphone or earpiece device, a device embedded in eyeglasses or other equipment worn on a user's head, or other wearable or miniature device, a television, a computer display that does not contain an embedded computer, a gaming device, a navigation device, an embedded system such as a system in which electronic equipment with a display is mounted in a kiosk or automobile, a wireless internet-connected voice-controlled speaker, a wireless base station or access point, equipment that implements the functionality of two or more of these devices, or other electronic equipment.

As shown in FIG. 1, device 10 may include control circuitry 12. Control circuitry 12 may include storage such as storage circuitry 16. Storage circuitry 16 may include hard disk drive storage, nonvolatile memory (e.g., flash memory or other electrically-programmable-read-only memory configured to form a solid-state drive), volatile memory (e.g., static or dynamic random-access-memory), etc.

Control circuitry 12 may include processing circuitry such as processing circuitry 14. Processing circuitry 14 may be used to control the operation of device 10. Processing circuitry 14 may include on one or more microprocessors, microcontrollers, digital signal processors, host processors, baseband processor integrated circuits, application specific integrated circuits, central processing units (CPUs), etc. Control circuitry 12 may be configured to perform operations in device 10 using hardware (e.g., dedicated hardware or circuitry), firmware, and/or software. Software code for performing operations in device 10 may be stored on storage circuitry 16 (e.g., storage circuitry 16 may include non-transitory (tangible) computer readable storage media that stores the software code). The software code may sometimes be referred to as program instructions, software, data, instructions, or code. Software code stored on storage circuitry 16 may be executed by processing circuitry 14.

Control circuitry 12 may be used to run software on device 10 such as satellite navigation applications, internet browsing applications, voice-over-internet-protocol (VOIP) telephone call applications, email applications, media playback applications, operating system functions, etc. To support interactions with external equipment, control circuitry 12 may be used in implementing communications protocols. Communications protocols that may be implemented using control circuitry 12 include internet protocols, wireless local area network (WLAN) protocols (e.g., IEEE 802.11 protocols—sometimes referred to as Wi-Fi®), protocols for other short-range wireless communications links such as the Bluetooth® protocol or other wireless personal area network (WPAN) protocols, IEEE 802.11ad protocols, cellular telephone protocols, MIMO protocols, antenna diversity protocols, satellite navigation system protocols (e.g., global positioning system (GPS) protocols, global navigation satellite system (GLONASS) protocols, etc.), or any other desired communications protocols. Each communications protocol may be associated with a corresponding radio access technology (RAT) that specifies the physical connection methodology used in implementing the protocol.

Device 10 may include input-output circuitry 18. Input-output circuitry 18 may include input-output devices 20. Input-output devices 20 may be used to allow data to be supplied to device 10 and to allow data to be provided from device 10 to external devices. Input-output devices 20 may include user interface devices, data port devices, and other input-output components. For example, input-output devices 20 may include touch sensors, displays, light-emitting components such as displays without touch sensor capabilities, buttons (mechanical, capacitive, optical, etc.), scrolling wheels, touch pads, key pads, keyboards, microphones, cameras, buttons, speakers, status indicators, audio jacks and other audio port components, digital data port devices, motion sensors (accelerometers, gyroscopes, and/or compasses that detect motion), capacitance sensors, proximity sensors, magnetic sensors, force sensors (e.g., force sensors coupled to a display to detect pressure applied to the display), etc. In some configurations, keyboards, headphones, displays, pointing devices such as trackpads, mice, and joysticks, and other input-output devices may be coupled to device 10 using wired or wireless connections (e.g., some of input-output devices 20 may be peripherals that are coupled to a main processing unit or other portion of device 10 via a wired or wireless link).

Input-output circuitry 18 may include wireless circuitry 22 to support wireless communications. Wireless circuitry 22 may include radio-frequency (RF) transceiver circuitry 24 formed from one or more integrated circuits, power amplifier circuitry, low-noise input amplifiers, passive RF components, one or more antennas such as antenna 40, transmission lines such as transmission line 26, and other circuitry for handling RF wireless signals. Wireless signals can also be sent using light (e.g., using infrared communications). While control circuitry 12 is shown separately from wireless circuitry 22 in the example of FIG. 1 for the sake of clarity, wireless circuitry 22 may include processing circuitry that forms a part of processing circuitry 14 and/or storage circuitry that forms a part of storage circuitry 16 of control circuitry 12 (e.g., portions of control circuitry 12 may be implemented on wireless circuitry 22). As an example, control circuitry 12 (e.g., processing circuitry 14) may include baseband processor circuitry or other control components that form a part of wireless circuitry 22.

Radio-frequency transceiver circuitry 24 may include wireless local area network transceiver circuitry that handles 2.4 GHz and 5 GHz bands for Wi-Fi® (IEEE 802.11) or other WLAN communications bands and may include wireless personal area network transceiver circuitry that handles the 2.4 GHz Bluetooth® communications band or other WPAN communications bands. If desired, radio-frequency transceiver circuitry 24 may handle other bands such as cellular telephone bands, near-field communications bands (e.g., at 13.56 MHz), millimeter or centimeter wave bands (e.g., communications at 10-300 GHz), and/or other communications bands. Configurations in which radio-frequency transceiver circuitry 24 handles wireless local area network bands (e.g., at 2.4 GHz and 5 GHz) may sometimes be described herein as an example. In general, however, radio-frequency transceiver circuitry 24 may be configured to cover any suitable communications bands of interest.

Wireless circuitry 22 may include one or more antennas such as antenna 40. Antennas such as antenna 40 may be formed using any suitable antenna types. For example, antennas in device 10 may include antennas with resonating elements that are formed from loop antenna structures, patch antenna structures, inverted-F antenna structures, slot antenna structures, planar inverted-F antenna structures, helical antenna structures, monopole antennas, dipoles, hybrids of these designs, etc. Parasitic elements may be included in antennas 40 to adjust antenna performance. Antenna 40 may be provided with a conductive cavity that backs the antenna resonating element of antenna 40 (e.g., antenna 40 may be a cavity-backed antenna such as a cavity-backed slot antenna). In some configurations, device 10 may have isolation elements between respective antennas 40 to help avoid antenna-to-antenna cross-talk. Different types of antennas may be used for different bands and combinations of bands. For example, one type of antenna may be used in forming a local wireless link antenna and another type of antenna may be used in forming a remote wireless link antenna. In some configurations, different antennas may be used in handling different bands for radio-frequency transceiver circuitry 24. Each antenna 40 may cover one or more bands. For example, antennas 40 may be single band wireless local area network antennas or dual band wireless local area network antennas.

As shown in FIG. 1, radio-frequency transceiver circuitry 24 may be coupled to antenna feed 32 of antenna 40 using transmission line 26. Antenna feed 32 may include a positive antenna feed terminal such as positive antenna feed terminal 34 and may include a ground antenna feed terminal such as ground antenna feed terminal 36. Transmission line 26 may be formed from metal traces on a printed circuit, cables, or other conductive structures. Transmission line 26 may have a positive transmission line signal path such as path 28 that is coupled to positive antenna feed terminal 34. Transmission line 26 may have a ground transmission line signal path such as path 30 that is coupled to ground antenna feed terminal 36. Path 28 may sometimes be referred to herein as signal conductor 28 and path 30 may sometimes be referred to herein as ground conductor 30.

Transmission line paths such as transmission line 26 may be used to route antenna signals within device 10. Transmission lines in device 10 may include coaxial cables, microstrip transmission lines, stripline transmission lines, edge-coupled microstrip transmission lines, edge-coupled stripline transmission lines, transmission lines formed from combinations of transmission lines of these types, etc. Transmission lines in device 10 such as transmission line 26 may be integrated into rigid and/or flexible printed circuit boards. In one suitable arrangement, transmission lines such as transmission line 26 may also include transmission line conductors (e.g., signal conductors 28 and ground conductors 30) integrated within multilayer laminated structures (e.g., layers of a conductive material such as copper and a dielectric material such as a resin that are laminated together without intervening adhesive). The multilayer laminated structures may, if desired, be folded or bent in multiple dimensions (e.g., two or three dimensions) and may maintain a bent or folded shape after bending (e.g., the multilayer laminated structures may be folded into a particular three-dimensional shape to route around other device components and may be rigid enough to hold its shape after folding without being held in place by stiffeners or other structures). All of the multiple layers of the laminated structures may be batch laminated together (e.g., in a single pressing process) without adhesive (e.g., as opposed to performing multiple pressing processes to laminate multiple layers together with adhesive).

Filter circuitry, switching circuitry, impedance matching circuitry, and other circuitry may be interposed within the paths formed using transmission lines such as transmission line 26 and/or circuits such as these may be incorporated into antenna 40 (e.g., to support antenna tuning, to support operation in desired frequency bands, etc.). During operation, control circuitry 12 may use radio-frequency transceiver circuitry 24 and antenna(s) 40 to transmit and receive data wirelessly. Control circuitry 12 may, for example, receive wireless local area network communications wirelessly using radio-frequency transceiver circuitry 24 and antenna(s) 40 and may transmit wireless local area network communications wirelessly using radio-frequency transceiver circuitry 24 and antenna(s) 40.

Electronic device 10 may be provided with electronic device housing 38. Housing 38, which may sometimes be referred to as a case, may be formed of plastic, glass, ceramics, fiber composites, metal (e.g., stainless steel, aluminum, etc.), other suitable materials, or a combination of these materials. Housing 38 may be formed using a unibody configuration in which some or all of housing 38 is machined or molded as a single structure or may be formed using multiple structures (e.g., an internal frame structure covered with one or more outer housing layers). Configurations for housing 38 in which housing 38 includes support structures (a stand, leg(s), handles, etc.) may also be used. In one suitable arrangement that is described herein as an example, housing 38 includes a conductive inner frame, a conductive outer housing, and conductive support structures such as one or more conductive handles. The conductive handles (sometimes referred to herein as electronic device handles) may be used to help pick up, carry, move, or position device 10 (e.g., on a desktop, table top, network rack, or other surface). The electronic device handles may be secured (affixed) to the conductive inner frame. The conductive outer housing (sometimes referred to herein as a conductive outer sleeve) may be placed over the conductive inner frame. The electronic device handles may protrude through openings in the conductive outer sleeve.

Figure 2:
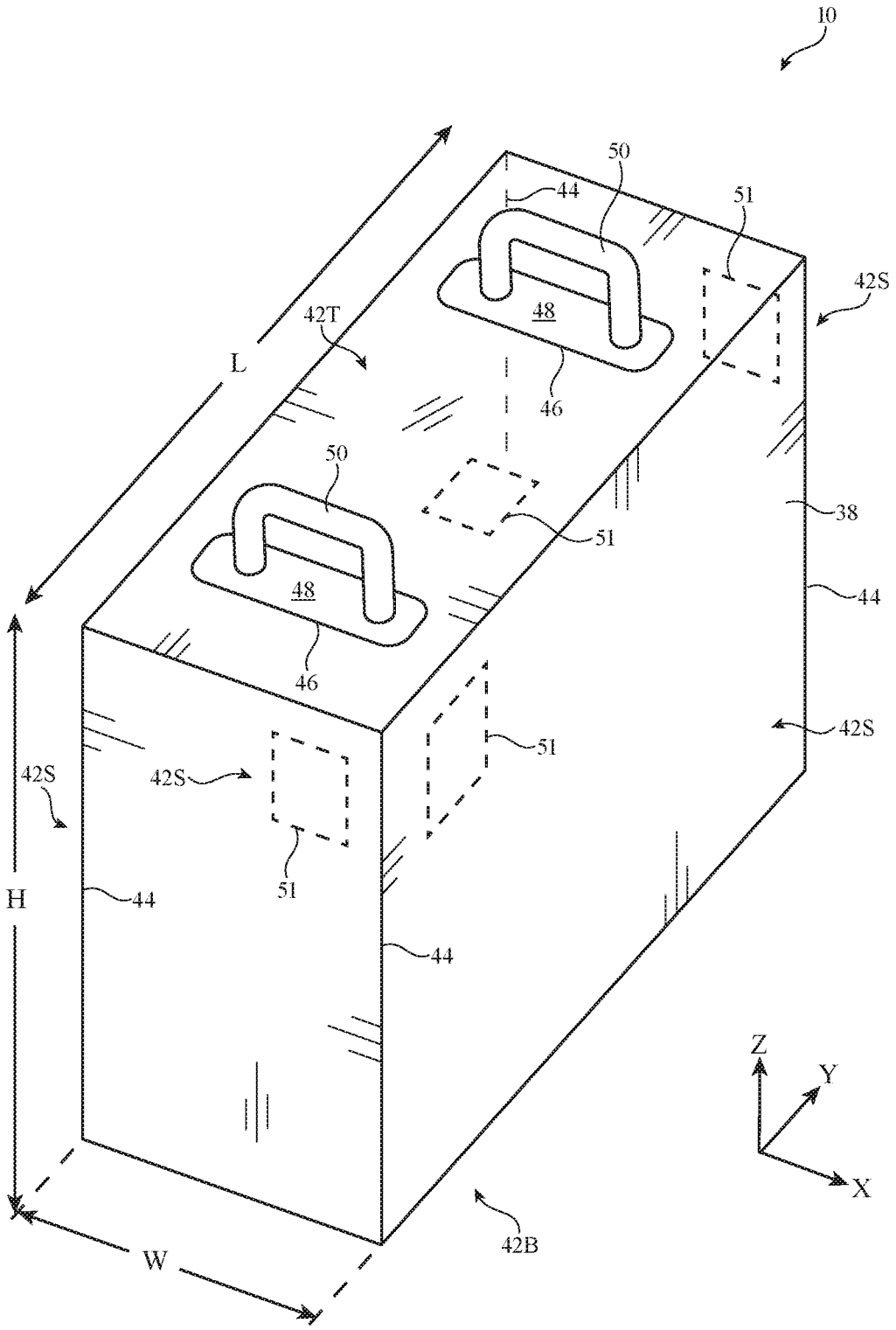
FIG. 2 is a perspective view of an illustrative electronic device in accordance with some embodiments.

A perspective view of an illustrative electronic device such as device 10 of FIG. 1 is shown in FIG. 2. In the example of FIG. 2, housing 38 is provided with a rectangular box shape. In general, device 10 may have a housing with any suitable shape (e.g., a box shape with a different number of sides, pyramidal, cylindrical, conical, spherical, a shape with a combination of curved sides and planar sides, etc.). The box-shaped housing of FIG. 2 is illustrative.

As shown in FIG. 2, housing 38 may be characterized by a width W, a height H, and a length L. The values of W, H, and L may be at least 1 mm, at least 10 mm, at least 100 mm, at least 300 mm, may be less than 1000 mm, less than 750 mm, may be less than 500 mm, may be less than 250 mm, or may be any other suitable value. In some configurations, housing 38 is low and wide (e.g., H may be less than W and less than L). In other configurations, housing 38 may be thinner and taller. For example, H may be at least two times W, at least 3 times W, or other suitably large value. If desired, L may be larger than W (e.g., L may be at least 1.5 times W, 2 times W, at least three times W, etc.). Other shapes and sizes may be used for housing 38 if desired. The example of FIG. 2 is illustrative.

Housing 38 may have edges such as edges that extend along the four corners 44 of housing 38 of FIG. 2 (e.g., the four corners of housing 38 when an outline of housing 38 is viewed from above). Each corner 44 may, for example, have an edge that extends vertically along vertical the Z-axis. Housing walls may be formed on the top and bottom of housing 38 (e.g., walls that lie parallel to the X-Y plane), the left and right sides of housing 38 (walls that lie parallel to the Y-Z plane), and/or on the front and rear sides of housing 38 (walls that lie parallel to the X-Z plane). In the example of FIG. 2, housing 38 has a bottom wall 42B, a top wall 42T, and four side walls 42S extending from bottom wall 42B to top wall 42T. In this type of arrangement, walls 42S, 42T, and 42B form an enclosure for device 10 that is a six-sided box.

Walls 42T, 42B, and/or 42S may be formed from conductive material such as metal (e.g., aluminum, steel, etc.), other conductive materials, and/or insulating material (e.g., polymer, etc.). In some configurations, walls 42T, 42B, and/or 42S, or portions of walls 42T, 42B, and/or 42S may have areas such as areas 51 to accommodate buttons and other input-output devices 20 (FIG. 1), ports for coupling to removable storage media, ports that facilitate coupling to peripherals (e.g., data ports), audio ports, air vents for drawing air into the interior of housing 38, air vents for expelling air out of the interior of housing 38, etc. Areas 51 may be located on one or more of walls 42T, 42B, and 42S (as an example). For example, an area 51 that contains a power port and data and display ports and may be located on the rear wall of housing 38.

Housing 38 may include openings 46. Openings 46 may be formed in one of the walls of housing 38 such as top wall 42T. Electronic device handles such as electronic device handles 50 may protrude through openings 46. Device 10 may have one, two, or more than two electronic device handles 50. In one suitable arrangement that is sometimes described herein as an example, device 10 includes two electronic device handles 50 protruding through two respective openings 46.

Support structures for electronic device handles 50 such as conductive support plates 48 may be aligned with (e.g., formed within) openings 46. In one suitable arrangement that is described herein as an example, housing 38 (e.g., top wall 42T, side walls 42S, and bottom wall 42B), electronic device handles 50, and conductive support plates 48 are each formed using conductive material such as metal (e.g., aluminum, steel, iron, silver, gold, copper, metal alloys, etc.). This is merely illustrative and, if desired, some or all of housing 38, conductive support plates 48, and/or electronic device handles 50 may be formed from dielectric materials.

Conductive support plates 48 may help to hold electronic device handles 50 in place and may help to protect the interior of housing 38 from contamination and damage. Electronic device handles 50 may be secured to conductive support plates 48 using adhesive, solder, welds, screws, or other fastening structures. In another suitable arrangement, electronic device handles 50 may extend through openings in conductive support plates 48 (e.g., without being adhered or affixed to conductive support plates 48). This may allow electronic device handles 50 to be secured to an internal frame of housing 38 through conductive support plates 48. Conductive support plates 48 may sometimes be referred to herein as conductive plates 48, conductive islands 48 (e.g., because conductive support plates 48 may be aligned with openings 46 without contacting the conductive outer sleeve for housing 38), or conductive members 48.

One or more antennas such as antenna 40 of FIG. 1 may be formed in device 10 to handle wireless communications. In some configurations, antennas or parts of antenna may be formed from internal device components (e.g., antenna traces on printed circuit boards mounted within the interior of housing 38). However, in scenarios where housing 38 is formed from metal, the metal in housing 38 can undesirably block antennas formed from internal device components from conveying radio-frequency signals with external wireless communications equipment. In other configurations, antennas or parts of antennas may be formed from conductive housing structures in housing 38. For example, conductive support plates 48, top wall 42T, and/or electronic device handles 50 may be used to form antennas or parts of antennas for device 10. These conductive structures may be provided with one or more openings to form slot antennas, inverted-F antennas, other antennas (e.g., the antenna resonating element and/or antenna ground for other antennas), hybrid antennas that include resonating elements of more than one type, etc. In one suitable arrangement that is sometimes described herein as an example, conductive support plates 48, top wall 42T, and/or electronic device handles 50 may be used to form slot antennas for device 10. Forming antennas using conductive support plates 48, electronic device handles 50, and top wall 42T may allow the antennas to be placed at a location as far from the interior of device 10 as possible, thereby optimizing antenna gain and efficiency (e.g., without conductive portions of housing 38 blocking the radio-frequency signals conveyed by the antennas).

Figure 3:
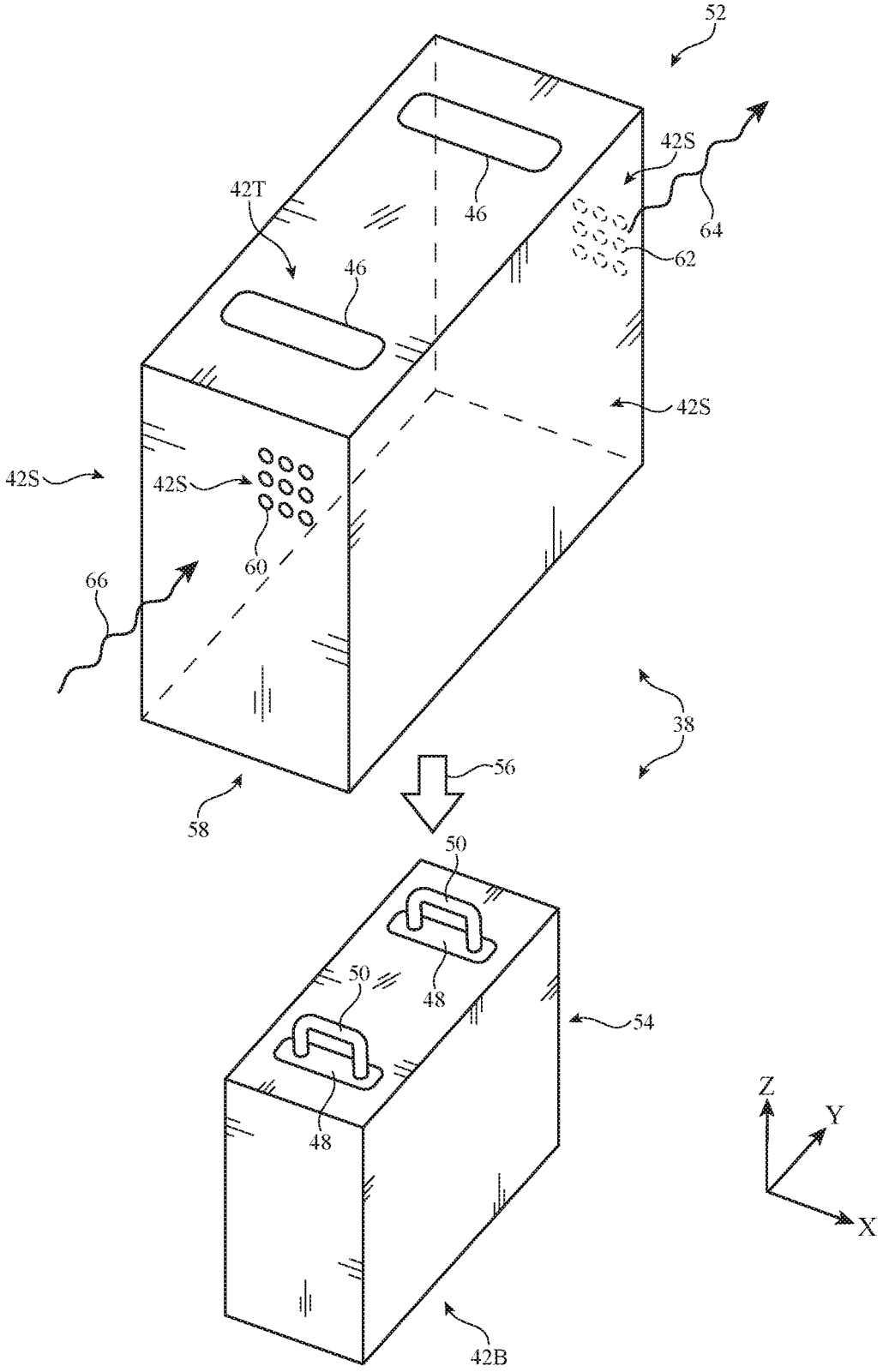
FIG. 3 is an exploded perspective view of an illustrative electronic device in accordance with some embodiments.

FIG. 3 is an exploded perspective view of device 10 showing how housing 38 may be formed from both an internal housing structure such as a conductive inner frame and an external housing structure such as a conductive outer sleeve. As shown in FIG. 3, housing 38 of device 10 may include conductive outer sleeve 52 and conductive inner frame 54. Portions of conductive inner frame 54 and/or portions of conductive outer sleeve 52 may be used to form part of the antenna ground for one or more antennas in device 10 if desired.

Conductive inner frame 54 may house control circuitry 12, radio-frequency transceiver circuitry 24, and some or all of control circuitry 12 of FIG. 1, for example. Conductive inner frame 54 may be formed from conductive material such as metal. If desired, portions of conductive inner frame 54 may be formed from plastic or other dielectric materials. Conductive inner frame 54 may have openings or ports to accommodate components within areas 51 of FIG. 2 if desired.

As shown in FIG. 3, electronic device handles 50 may be mounted and secured (affixed) to conductive inner frame 54. Electronic device handles 50 may have threaded ends that are screwed into threaded holes in conductive inner frame 54 or may be secured to conductive inner frame 54 using conductive adhesive, screws, welds, and/or any other desired fastening structures. In another suitable arrangement, electronic device handles 50 and conductive inner frame 54 may be formed from a single integral piece of metal. Each electronic device handle 50 may be secured to a respective conductive support plate 48 or may pass through openings in conductive support plate 48. Conductive support plates 48 may be secured to conductive inner frame 54 using adhesive, solder, welds, springs, pins, screws, and/or any other desired fastening structures (e.g., conductive support plates 48 may be electrically coupled to conductive inner frame 54 using the fastening structures). In another suitable arrangement, conductive support plates 48 may be placed over conductive inner frame 54 without being affixed or coupled to conductive inner frame 54. In yet another suitable arrangement, conductive support plates 48 and conductive inner frame 54 may be formed from a single integral piece of metal.

Conductive outer sleeve 52 may include an open end 58 that is placed over conductive inner frame 54, as shown by arrow 56. Conductive outer sleeve 52 may be slid into place over conductive inner frame 54. When secured in place, electronic device handles 50 on conductive inner frame 54 may extend (protrude) through respective openings 46 in conductive outer sleeve 52. Conductive support plates 48 may fill the lateral portions of conductive openings 46 that are not occupied by electronic device handles 50 (e.g., to protect conductive inner frame 54 from contaminants and damage). When conductive outer sleeve 52 is in place over conductive inner frame 54, conductive outer sleeve 52 may, if desired, be secured to conductive inner frame 54 using clips, screws, springs, pins, latches, magnets, and/or any other desired fastening structures. If desired, conductive outer sleeve 52 may be removable from conductive inner frame 54 to allow the components of conductive inner frame 54 to be removed, replaced, repaired, cleaned, or upgraded over time.

If desired, one or more side walls 42S may be provided with openings to allow air to pass into and out of conductive outer sleeve 52. For example, a first air vent (port) 60 may be formed from openings in a first side wall 42S of conductive outer sleeve 52 and a second air vent (port) 62 may be formed from openings in a second side wall 42S opposite to the first side wall 42S. Air vent 60 may serve as an air intake vent that draws in air 66 to help cool components within conductive inner frame 54. Air vent 62 may serve as an air exhaust that expels (heated) exhaust air 64 out of housing 38. Conductive inner frame 54 may include air vents (not shown in FIG. 3 for the sake of clarity) that overlap with the air vents in conductive outer sleeve 52. In this way, the components within device 10 may operate at a sufficiently low operating temperature despite the presence of conductive outer sleeve 52. This example is merely illustrative and, if desired, additional air vents may be formed on additional walls of housing 38.

Figure 4:
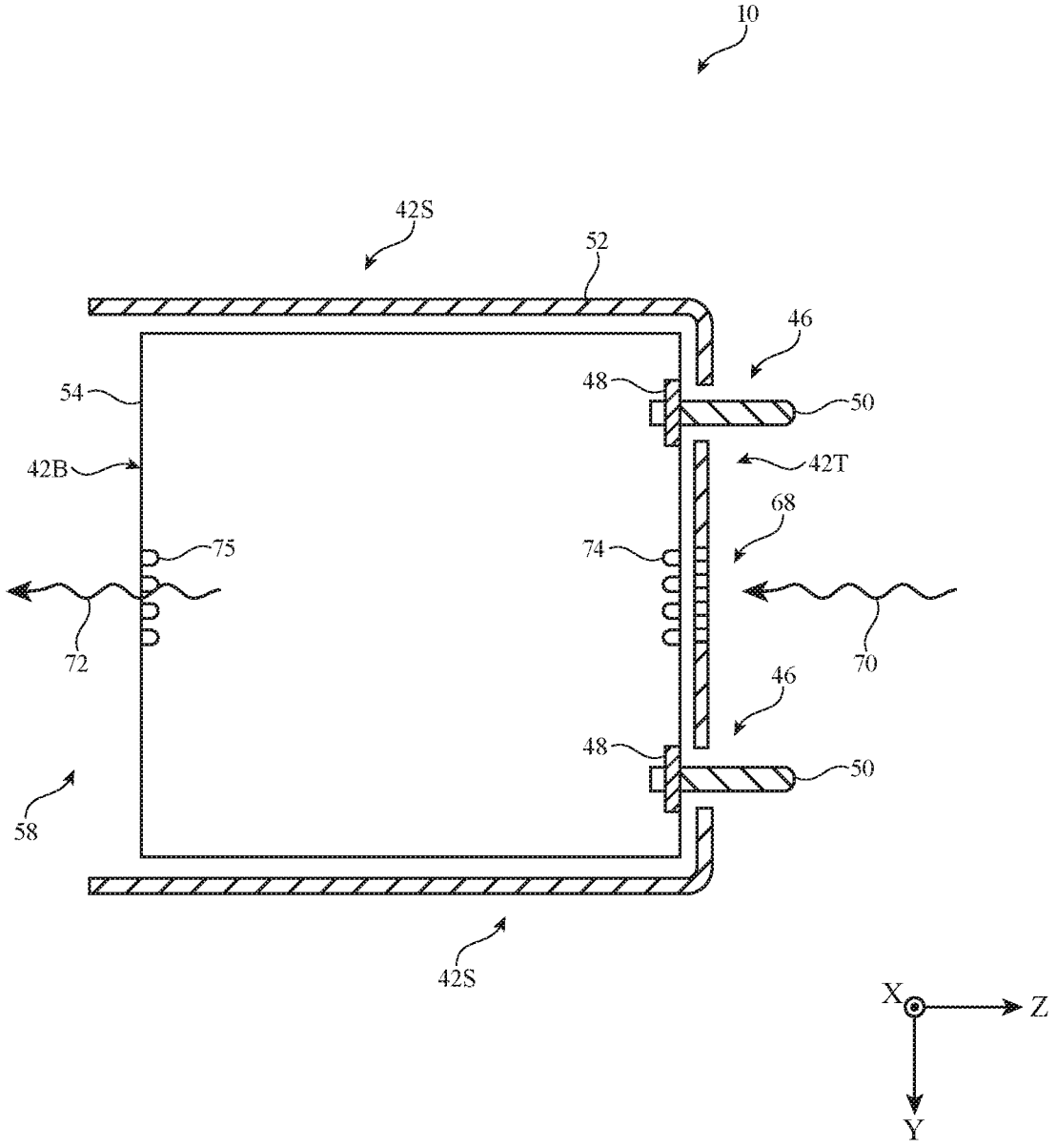
FIG. 4 is a cross-sectional side view of an illustrative electronic device in a rack-based configuration in accordance with some embodiments.

In the example of FIG. 3, housing 38 is provided with an upright configuration in which bottom wall 42B rests an underlying surface such as the ground or a tabletop. In another suitable arrangement, housing 38 may be provided with a rack-based configuration. FIG. 4 is a cross-sectional side view of device 10 in an example where housing 38 is provided with a rack-based configuration. In the rack-based configuration of FIG. 4, a given side wall 42S of conductive outer sleeve 52 faces downward and is placed onto a surface such as a surface of a network rack (e.g., a network rack in a data center, server farm, or elsewhere). Multiple devices 10 may be stacked in the network rack.

Conductive outer sleeve 52 may be slid over conductive inner frame 54 from right to left. Electronic device handles 50 may protrude through openings 46. In the rack-based configuration of FIG. 4, conductive outer sleeve 52 may be provided with an air vent such as air vent 68 in top wall 42T at the right of housing 38. Conductive inner frame 54 may be provided with air vents 74 and 75 that are aligned with air vent 68. Air vent 68 and air vent 74 may serve as an air intake that draws in air 70 to help cool components within conductive inner frame 54. Air vent 75 may serve as an air exhaust that expels exhaust air 72 through bottom wall 42B at the left of housing 38. In this way, the components within device 10 may operate at a sufficiently low operating temperature even when device 10 is placed within a network rack, despite the presence of conductive outer sleeve 52. This example is merely illustrative and, if desired, additional air vents may be formed on additional walls of housing 38.

Electronic device handles 50, conductive support plates 48, portions of conductive inner frame 54, and/or portions of conductive outer sleeve 52 may be used to form one or more slot antennas in device 10 (e.g., regardless of whether housing 38 is provided with an upright configuration as shown in FIG. 3 or a rack-based configuration as shown in FIG. 4).

Figure 5:
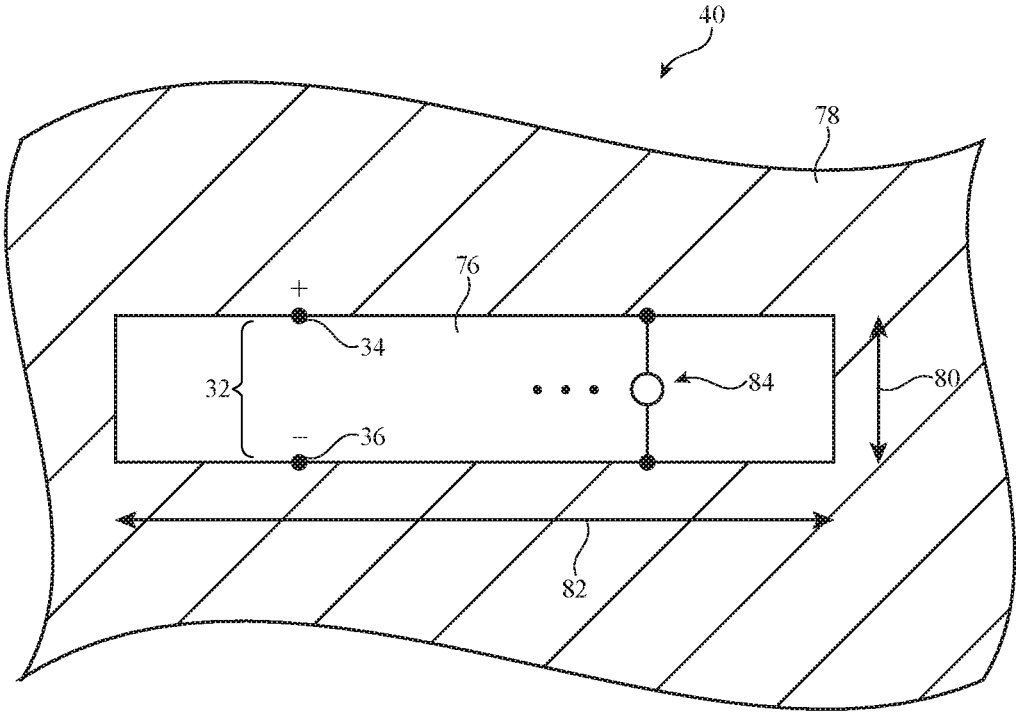
FIGS. 5 and 6 are diagrams of illustrative slot antennas in accordance with some embodiments.

An illustrative slot antenna for device 10 is shown in FIG. 5. As shown in FIG. 5, antenna 40 may include a conductive structure such as structure 78. Conductive structure 78 may be provided with a dielectric-filled slot element as slot element 76. Slot element 76 may serve as the antenna resonating element for antenna 40 and may sometimes be referred to herein as slot 76, slot radiating element 76, radiating element 76, resonating element 76, slot resonating element 76, or slot antenna resonating element 76.

Antenna 40 may be feed using antenna feed 32 coupled across slot element 76. In particular, positive antenna feed terminal 34 and ground antenna feed terminal 36 of antenna feed 32 may be coupled to opposing sides of slot element 76 along the length 82 of slot element 76. Radio-frequency antenna current may flow between antenna feed terminals 34 and 36 around the perimeter of slot element 76. Corresponding radio-frequency signals may be radiated by slot element 76. Similarly, radio-frequency signals received by antenna 40 may produce radio-frequency antenna currents around slot element 76 that are received by antenna feed 32. Slot element 76 may have a width 80 perpendicular to length 82. Width 80 may be less than length 82.

The perimeter of slot element 76 (e.g., length 82 and width 80) may be selected to configure slot element 76 to radiate radio-frequency signals within desired frequency bands. For example, when length 82 is significantly greater than width 80 (e.g., when slot element 76 is long and narrow), length 82 may be approximately equal to (e.g., within 15% of) one-half of an effective wavelength of operation of antenna 40. The effective wavelength of operation may be equal to the free space wavelength of the radio-frequency signals conveyed by antenna 40 multiplied by a constant factor that is determined based on the dielectric constant of the material within slot element 76. Harmonic modes of slot element 76 may also be configured to cover additional frequency bands.

Antenna feed 32 may be coupled across slot element 76 at a distance from the left or right edge (side) of slot element 76 that is selected to match the impedance of antenna 40 to the impedance of the corresponding transmission line (e.g., transmission line 26 of FIG. 1). For example, antenna current flowing around slot element 76 may experience an impedance of zero at the left and right edges of slot element 76 (e.g., a short circuit impedance) and an infinite (open circuit) impedance at the center of slot element 76 (e.g., at a fundamental frequency of the slot). Antenna feed 32 may be located between the center of slot element 76 and one of the left or right edges at a location where the antenna current experiences an impedance that matches the impedance of the corresponding transmission line (e.g., 50 Ohms).

Optional tuning components may be coupled to antenna 40. As an example, one or more antenna tuning components such as illustrative component 84 of FIG. 5 may bridge slot element 76. Component 84 may be, for example, a tunable capacitor, a tunable inductor, a tunable component formed from a series of discrete components that can be selectively switched into or out of use with corresponding switching circuitry (e.g., a multiplexer coupled to a set of capacitors or a set of inductors to form, respectively, a tunable capacitor or tunable inductor), etc. In another suitable arrangement, component 84 may include fixed components such as a capacitor having a fixed capacitance, an inductor having a fixed inductance, and/or a resistor having a fixed resistance. Component 84 may have a first terminal coupled to conductive structure 78 on a first side of slot element 76 and a second terminal coupled to conductive structure 78 on an opposing second side of slot element 76 or may otherwise be coupled to conductive portions of antenna 40 and/or the circuitry associated with antenna 40 (e.g., matching circuits, etc.). Component 84 may be configured to adjust the frequency band of the radio-frequency signals conveyed by antenna 40.

In some configurations, component 84 may be formed in an elongated threaded member (sometimes referred to as an antenna tuning circuit bolt). The transmission line for antenna 40 may also be coupled to antenna feed 32 using an elongated threaded member such as a bolt (sometimes referred to as an antenna feed bolt). An antenna feed bolt may have positive and ground portions (terminals) that couple to conductive structure 78 on opposing sides of slot element 76 and/or that are otherwise mounted to conductive structure 78. The antenna feed bolt may be coupled to the transmission line using threaded radio-frequency connectors. If desired, other types of structures (e.g., brackets, screws, clips, springs, pins, conductive adhesive, welds, soldered terminals, etc.) may be used in coupling the transmission line to antenna feed 32 and in coupling component 84 to conductive structure 78.

Figure 6:
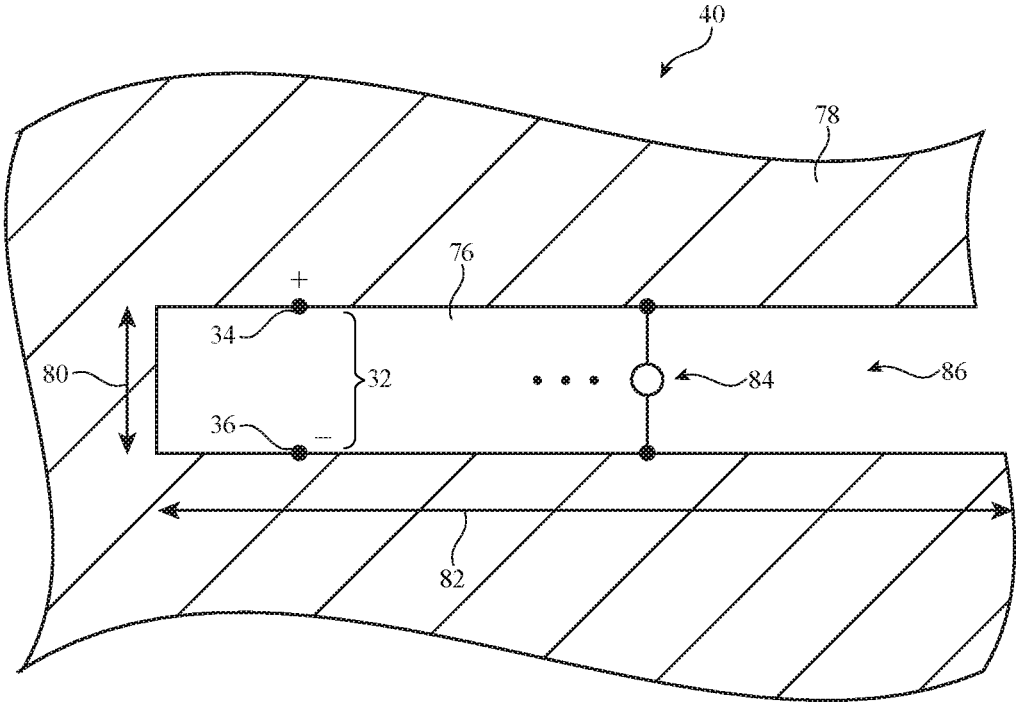

In the example of FIG. 5, slot element 76 is a closed slot because conductive structure 78 completely surrounds and encloses slot element 76. In another suitable arrangement, slot element 76 may be an open slot element, as shown in FIG. 6. Slot element 76 of FIG. 6 may be an open slot having an open end 86 that protrudes through conductive structure 78. In scenarios where slot element 76 is an open slot, the length 82 of slot element 76 may be approximately equal to one-quarter of the effective wavelength of operation of antenna 40. Harmonic modes of slot element 76 may also be configured to cover desired frequency bands.

It may be desirable for antennas 40 in device 10 to cover multiple frequency (communications) bands. In one suitable arrangement that is sometimes described herein as an example, the antennas in device 10 may be configured to cover a first frequency band (e.g., a 2.4 GHz WLAN or WPAN frequency band) and a second frequency band that is higher than the first frequency band (e.g., a 5 GHz WLAN frequency band). If desired, device 10 may include a first set of antennas 40 that cover the first frequency band and a second set of antennas 40 that cover the second frequency band. In another suitable arrangement, one or more antennas 40 may be provided with at least a first slot element 76 that is configured to convey radio-frequency signals in the first frequency band and at least a second slot element 76 that is configured to convey radio-frequency signals in the second frequency band. The first and second slot elements may have different perimeters that configure the slot elements to cover the different frequency bands, for example. Harmonic modes of the slot elements in antennas 40 may also configure the antennas to cover frequencies in the first and second frequency bands if desired. Combinations of these arrangements may be used, if desired, to cover frequencies in both the first and second frequency bands. Device 10 may include multiple antennas for covering each frequency band (e.g., using a multiple-input and multiple-output (MIMO) scheme). Use of a MIMO scheme may allow device 10 to maximize data throughput using antennas 40.

Conductive structure 78 of FIGS. 5 and 6 may be formed from electronic device handle 50, conductive support plate 48, a portion of conductive inner frame 54, and/or a portion of conductive outer sleeve 52 of FIGS. 2-4. If desired, different conductive structures may be used to define different sides of slot element 76 (e.g., electronic device handle 50, conductive support plate 48, a portion of conductive inner frame 54, and/or a portion of conductive outer sleeve 52 may each form different sides of slot element 76).

Figure 7:
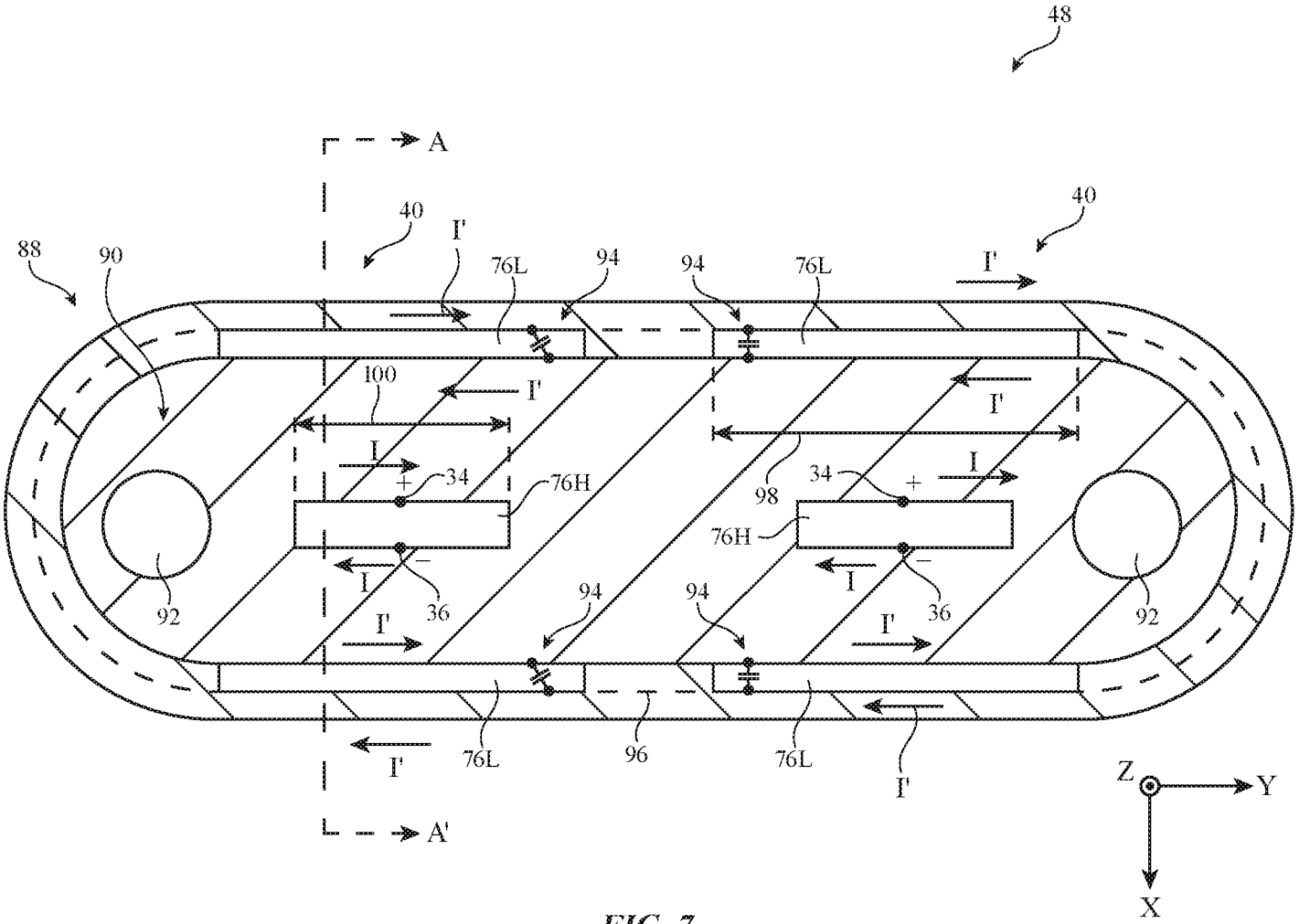
FIG. 7 is a top-down view of an illustrative conductive support plate for an electronic device handle having slot antennas in accordance with some embodiments.

FIG. 7 is a top-down view showing how conductive support plate 48 of FIGS. 3 and 4 may be used to form a pair of antennas 40. In the example of FIG. 7, conductive support plate 48 is shown without electronic device handle 50, conductive outer sleeve 52, and conductive inner frame 54 of FIGS. 3 and 4 for the sake of clarity. Two antennas 40 may be formed using slot elements in conductive support plate 48 (e.g., at the left and right sides of conductive support plate 48). Each antenna 40 may cover the same frequency bands (e.g., using a MIMO scheme). This example is merely illustrative and, if desired, conductive support plate 48 may include only a single antenna 40 or multiple antennas 40 that cover respective frequency bands.

As shown in FIG. 7, conductive support plate 48 may include a central portion 90 and a ring-shaped lip 88 extending around the periphery of central portion 90. Central portion 90 may lie within a first lateral plane (e.g., parallel to the X-Y plane of FIG. 7). Lip 88 may lie within a second lateral plane that extends parallel to the first lateral plane of central portion 90. Central portion 90 may be raised with respect to lip 88 (e.g., central portion 90 may lie higher along the Z-axis than lip 88). A vertical conductive wall (not shown in FIG. 7 for the sake of clarity) may extend parallel to the Z-axis and may couple central portion 90 to lip 88. The vertical conductive wall may run around some or all of the periphery of central portion 90.

When device 10 is fully assembled (e.g., as shown in FIGS. 2 and 4), conductive support plate 48 may be aligned with a corresponding opening 46 in conductive outer sleeve 52. The outline of opening 46 as defined by conductive outer sleeve 52 is shown by dashed line 96 of FIG. 7. Conductive outer sleeve 52 may overlap at least some of lip 88 without overlapping central region 90 of conductive support plate 48. Central portion 90 may include a pair of openings (holes) 92. Openings 92 may receive a corresponding electronic device handle 50. The electronic device handle may be attached to conductive inner frame 54 (FIGS. 3 and 4) through openings 92.

As shown in FIG. 7, each antenna 40 may include a first slot element 76H (e.g., a closed slot element such as slot element 76 of FIG. 5) in central portion 90. Each antenna 40 may also include second and third slot elements 76L in conductive lip 88 (e.g., closed slot elements such as slot element 76 of FIG. 5). Slot elements 76L may be formed in lip 88 on opposing sides of the slot element 76H in that antenna 40. This example is merely illustrative and, if desired, antenna 40 may include only a single slot element 76L. If desired, all of the edges of each slot element 76L may be defined by lip 88. In another suitable arrangement, one or more edges of each slot element 76L may be defined by lip 88 while one or more other edges of the slot element 76L are defined by central portion 90 and/or the vertical wall that couples central portion 90 to lip 88. Slot elements 76L each have longitudinal axes that extend parallel to the longitudinal axis of slot element 76H. This is merely illustrative and, if desired, slot elements 76H and 76L may have other shapes (e.g., shapes having any desired number of straight and/or curved edges) and other relative orientations.

Each antenna 40 may be fed by a corresponding antenna feed coupled across slot element 76H. For example, positive antenna feed terminal 34 and ground antenna feed terminal 36 may be coupled to central portion 90 of conductive support plate 48 at opposing sides of slot element 76H. Slot elements 76L may each have a length 98 (e.g., length 82 of FIG. 5) that configures slot elements 76L to radiate in the first frequency band (e.g., at 2.4 GHz). Slot element 76H may have a length 100 (e.g., length 82 of FIG. 5) that configures slot element 76H to radiate in the second frequency band (e.g., at 5 GHz). Slot elements 76L may therefore sometimes be referred to herein as low band slot elements 76L whereas slot elements 76H are sometimes referred to herein as high band slot elements 76H. One or more tuning components (e.g., components 84 of FIG. 5) such as tuning capacitor 94 of FIG. 7 may be coupled across each low band slot element 76L. Tuning capacitors 94 may serve to shift the radiating frequency of low band slot elements 76L lower so that low band slot elements 76L radiate in the first frequency band (e.g., tuning capacitors 94 may configure the slot elements to cover lower frequencies than the slot elements would otherwise cover for their given length 98 in the absence of tuning capacitors 94). The example of FIG. 7 is merely illustrative and, in general, any desired tuning components may be used in place of tuning capacitors 94 (e.g., resistors, inductors, capacitors, etc.). Tuning components may be coupled across high band slot element 74H if desired.

During signal transmission, radio-frequency signals in the first and second frequency bands may be transmitted over positive antenna feed terminal 34 and ground antenna feed terminal 36. The transmitted radio-frequency signals may produce a corresponding antenna current I that runs around the perimeter of high band slot element 76H. High band slot element 76H may radiate the radio-frequency signals corresponding to antenna current I in the second frequency band. Antenna current I may also induce (e.g., via near-field electromagnetic coupling) a corresponding antenna current I' in the first frequency band to flow around the perimeter of the low band slot elements 76L. Low band slot elements 76L may radiate the radio-frequency signals in the second frequency band corresponding to antenna current I'. Similarly, during signal reception, radio-frequency signals in the first frequency band may be received by low band lot elements 76L and may produce antenna current I' in the first frequency band around low band slot elements 76L. Antenna current I' may induce a portion of antenna current I around high band slot element 76H. At the same time, radio-frequency signals in the second frequency band may be received by high band slot element 76H and may produce an additional portion of antenna current I. The radio-frequency signals received in the first and second frequency bands may be passed to transceiver circuitry (e.g., radio-frequency transceiver circuitry 24 of FIG. 1) via positive antenna feed terminal 34 and ground antenna feed terminal 36.

The example of FIG. 7 is merely illustrative. If desired, conductive support plate 48 may include more than two antennas 40. Conductive support plate 48 may have other shapes (e.g., a rectangular shape, oval shape, circular shape, other shapes with curved and/or straight edges, combinations of these, etc.). Similar antennas 40 may be formed in each conductive support plate 48 of device 10 (e.g., for each electronic device handle 50 in device 10 as shown in FIGS. 2-4). This may allow device 10 to perform communications using a MIMO scheme in both 2.4 GHz and 5.0 GHz frequency bands. If desired, the pair of low band slots elements 76L in each antenna 40 may be formed from a single continuous slot that extends through lip 88 and around a respective one of openings 92. In this arrangement, the presence of the electronic device handle in openings 92 may serve to electrically divide the single continuous slot into two portions (e.g., low band slot elements 76L) having electrical lengths 98.

Figure 8:
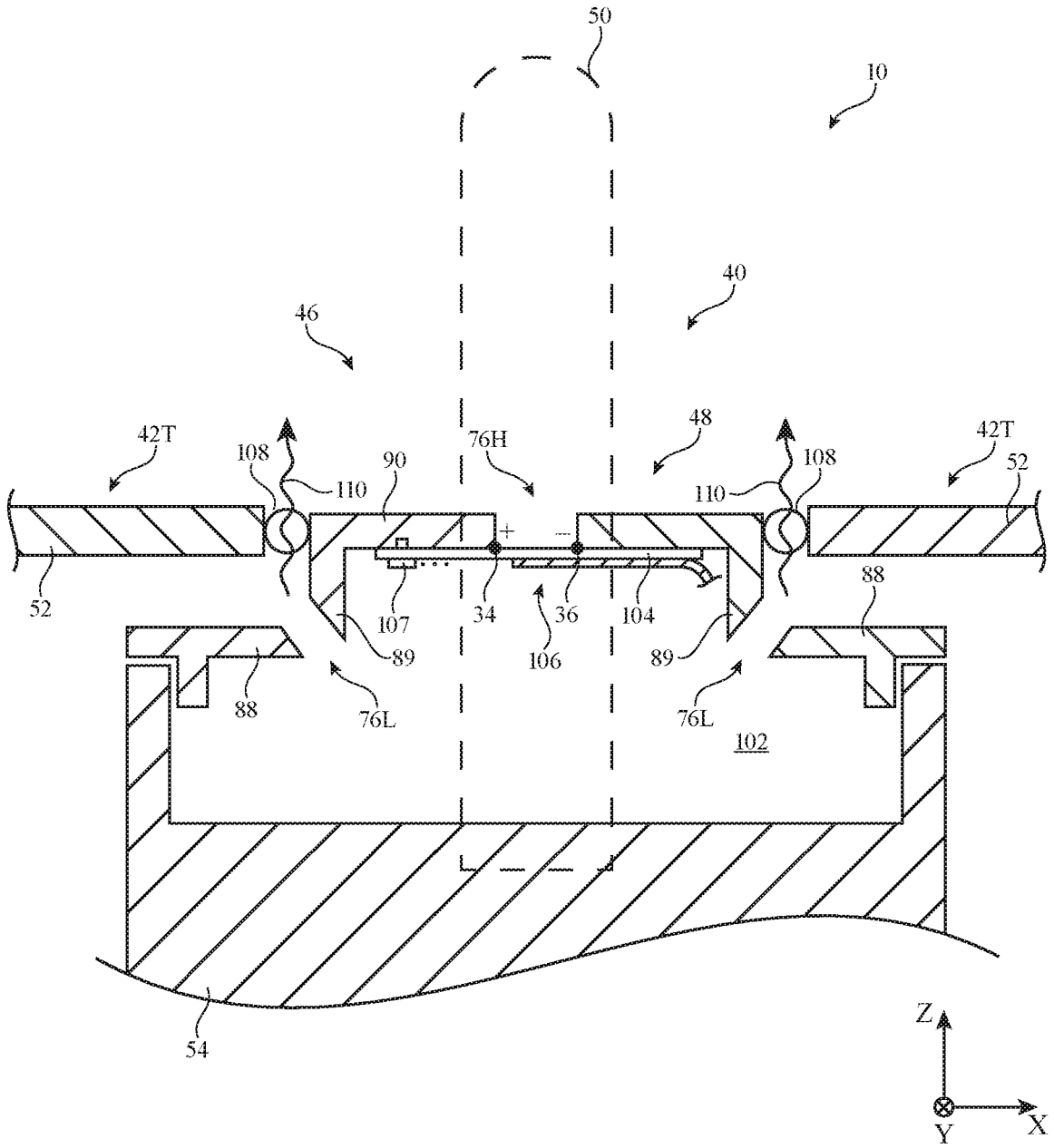
FIG. 8 is a cross-sectional side view of an illustrative slot antenna formed in a conductive support plate for an electronic device handle in accordance with some embodiments.

FIG. 8 is a cross-sectional side view showing conductive support plate 48 while mounted within device 10 (e.g., as viewed along line AA' of FIG. 7). As shown in FIG. 8, conductive support plate 48 may include vertical walls 89 that extend from central portion 90 to lip 88. Lip 88 may be mounted to a top surface of conductive inner frame 54. Lip 88 may be adhered to conductive inner frame 54 using conductive adhesive, springs, clips, brackets, pins, solder, welds, or other interconnect structures. The interconnect structures may, if desired, electrically couple conductive support plate 48 to conductive inner frame 54 (e.g., so that conductive support plate 48 and conductive inner frame 54 collectively define conductive edges of a dielectric-filled cavity 102). Dielectric-filled cavity 102 may be filled with air, plastic, or other dielectric materials. Dielectric-filled cavity 102 may serve as a cavity-back that helps to optimize the gain and radiation pattern for antenna 40. This example is merely illustrative and, if desired, conductive support plate 48 may be mounted to conductive inner frame 54 without adhesive.

Conductive support plate 48 may be aligned with opening 46 in top wall 42T of conductive outer sleeve 52. Conductive outer sleeve 52 may be placed over conductive inner frame and conductive support plate 48. If desired, central portion 90 of conductive support plate 48 may lie flush with the outer surface of top wall 42T. Conductive outer sleeve 52 may overlap some or all of lip 88. A dielectric gasket such as gasket 108 may extend around the lateral periphery of central portion 90 of conductive support plate 48. Gasket 108 may help keep the interior of device 10 free from contaminants and may help prevent damage to conductive outer sleeve 52 and conductive support plate 48 during assembly of device 10. Gasket 108 may be formed from rubber, foam, plastic, ceramic, polymer, or any other desired dielectric materials.

Electronic device handle 50 may extend through openings in central portion 90 of conductive support plate 48 (e.g., openings 92 of FIG. 7). Electronic device handle 50 may be secured to conductive inner frame 54. Electronic device handle 50 may be secured to conductive inner frame 54 using solder, welds, adhesive, screws, pins, clips, springs, and/or any other desired conductive interconnect structures. In another suitable arrangement, electronic device handle 50 may include threaded ends that are screwed into threaded openings of conductive inner frame 54. Electronic device handle 50 may be electrically coupled to conductive inner frame 54.

High band slot element 76H may be formed in central portion 90 of conductive support plate 48. Low band slot elements 76L may be formed in lip 88 (e.g., a respective low band slot element 76L may be formed on either side of high band slot element 76H). In the example of FIG. 8, low band slot elements 76L are formed at the corner between vertical walls 89 and lip 88. This is merely illustrative and, if desired, low band slot elements 76L may be formed entirely within lip 88, entirely within vertical walls 89, at the corner between vertical walls 89 and central portion 90, or entirely within central portion 90.

A transmission line such as coaxial cable 106 may be used to feed antenna 40. Coaxial cable 106 (e.g., a coaxial cable used to form transmission line 26 of FIG. 1) may have a central signal conductor (e.g., signal conductor 28 of FIG. 1) coupled to positive antenna feed terminal 34 at a first side of high band slot element 76H. Coaxial cable 106 may have a ground conductor such as an outer shielding braid (e.g., ground conductor 30 of FIG. 1) coupled to ground antenna feed terminal 36.

In some scenarios (e.g., scenarios where conductive support plate 48 is formed from anodized aluminum), it can be difficult to solder components such as the signal and ground conductors of coaxial cable 106 to the conductive support plate. To help facilitate coupling between the antenna feed and coaxial cable 106, antenna 40 may be provided with printed circuit board such as printed circuit board 104. Printed circuit board 104 may be a rigid printed circuit board or a flexible printed circuit (e.g., a flexible printed circuit having polyimide or other flexible printed circuit substrate layers). Printed circuit board 104 may serve as an interposer between coaxial cable 106 and the antenna feed for antenna 40.

Coaxial cable 106 may be mounted to a first side of printed circuit board 104. An opposing second side of printed circuit board 104 may be mounted to conductive support plate 48. Printed circuit board 104 may be secured to conductive support plate 48 using one or more conductive screws 107. Conductive screws 107 may pass through printed circuit board 104 and may be received by threaded screw holes (e.g., screw standoffs) in conductive support plate 48. If desired, other fastening structures such as adhesive may be used to help secure printed circuit board 104 to conductive support plate 48. Conductive screws 107 may be used to couple conductive traces on printed circuit board 104 to conductive support plate 48. For example, the signal conductor and ground conductor for coaxial cable 106 may be coupled to conductive traces on printed circuit board 104 (e.g., using solder). Conductive screws 107 may be used to couple the conductive traces for the signal conductor to positive antenna feed terminal 34 and to couple the conductive traces for the ground conductor to ground antenna feed terminal 36. Tuning components (e.g., tuning capacitors 94 of FIG. 7) may also be formed on printed circuit board 104 (e.g., using surface mount technology or other techniques). Conductive screws 107 may also be used to couple the terminals on the tuning components to different locations on conductive support plate 48 (e.g., to different sides of low band slot elements 76L).

Antenna 40 may convey radio-frequency signals in the first frequency band using low band slot elements 76L. Low band slot elements 76L may transmit the radio-frequency signals 110 in the first frequency band through opening 46 and gasket 108. When placed within opening 46, central portion 90 of conductive support plate 48 may be laterally separated from conductive outer sleeve 52 by a ring-shaped gap that laterally extends around central portion 90 (e.g., a ring-shaped gap that is filled by gasket 108). The gap (e.g., gasket 108) may have a width (e.g., as measured parallel to the X-axis of FIG. 8) that is sufficiently large so as to allow radio-frequency signals 110 to pass through the gap with satisfactory efficiency (e.g., greater than 1 mm, greater than 2 mm, greater than 3 mm, greater than 5 mm, etc.). Similarly, low band slot elements 76L may receive the radio-frequency signals in the first frequency band through gasket 108. High band slot element 76H may transmit and receive the radio-frequency signals in the second frequency band and may indirectly feed low band slot elements 76L in the first frequency band (e.g., via near-field electromagnetic coupling). Dielectric-filled cavity 102 may help to optimize the gain and radiation pattern of low band slot elements 76L and high band slot element 76H. In this way, almost the entirety of opening 46 and dielectric-filled cavity 102 may serve as a radiating volume for antenna 40. This may configure antenna 40 to exhibit a relatively high antenna efficiency and bandwidth.

Figure 9:
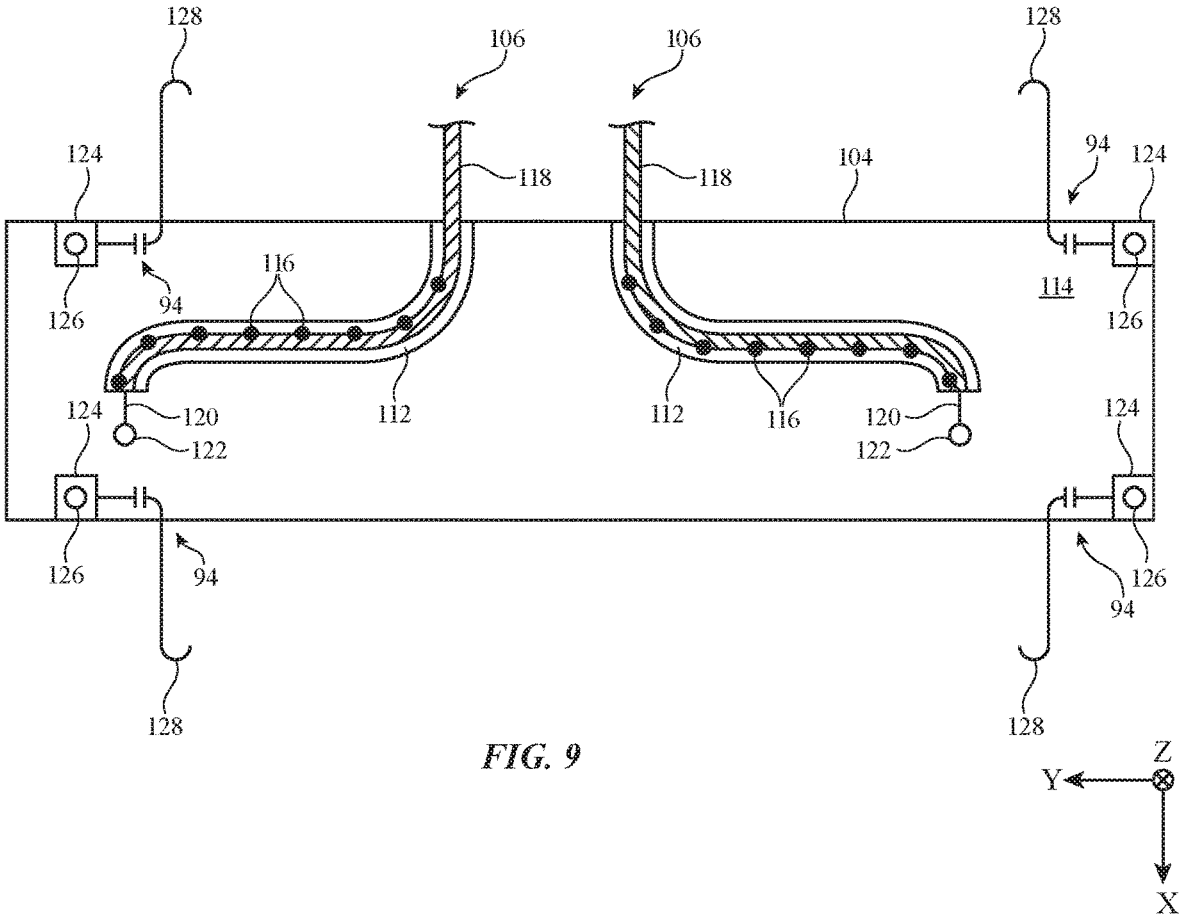
FIG. 9 is a bottom-up view of an illustrative printed circuit board that that may be used to feed a slot antenna of the type shown in FIG. 8 in accordance with some embodiments.

If desired, printed circuit board 104 may be used to couple separate transmission lines to each antenna 40 formed in conductive support plate 48. FIG. 9 is a bottom-up view of printed circuit board 104. As shown in FIG. 9, printed circuit board 104 may have a lateral surface 114. Surface 114 may face the conductive inner frame of device 10 (e.g., conductive inner frame 54 of FIG. 8). Conductive ground traces 112 may be patterned on surface 114. First and second coaxial cable 106 may each have ground conductors 118 that are soldered to conductive ground traces 112 using solder 116. Conductive ground traces 112 may be coupled to ground traces on an opposing surface of printed circuit board 104 using one or more conductive through vias. Each coaxial cable 106 may convey radio-frequency signals for a corresponding one of the antennas in conductive support plate 48 (e.g., a respective one of the two antennas 40 shown in FIG. 7).

Each coaxial cable 106 may have an inner signal conductor 120 coupled to a respective contact pad 122. Contact pads 122 may each have an opening that overlaps a through-via in printed circuit board 104. The opening and through via may receive a corresponding conductive screw (e.g., a given one of conductive screws 107 of FIG. 8). The conductive screws may couple each contact pad 122 to a respective positive antenna feed terminal 34 on conductive support plate 48 while also helping to mechanically secure printed circuit board 104 in place on the conductive support plate. Screws may also be used to couple the conductive ground traces 112 for each coaxial cable 106 to a corresponding ground antenna feed terminal 36 on conductive support plate 48 if desired.

Antenna tuning components such as tuning capacitors 94 may also be formed on surface 114 of printed circuit board 104. For example, tuning capacitors 94 may be surface-mount capacitors that are coupled to surface 114 of printed circuit board 104. Each tuning capacitor 94 may have a first terminal coupled to a respective conductive ground trace 124 on surface 114 and a second terminal coupled to a corresponding conductive spring 128. Each conductive ground trace 124 may include a corresponding opening 126 that overlaps a through-via in printed circuit board 104. The opening and through via may receive a corresponding conductive screw (e.g., a given one of conductive screws 107 of FIG. 8). The conductive screws may couple each conductive ground trace 124 to a first side of a respective low band slot element 76L on conductive support plate 48 (e.g., while also helping to fasten the printed circuit board to the conductive support plate). Each conductive spring 128 may be coupled to the opposing side of that low band slot element 76L. Conductive springs 128 may be pressed and biased against the conductive support plate to ensure that a reliable electrical and mechanical connection is provided between tuning capacitors 94 and the conductive support plate. In this way, tuning capacitors 94 may be coupled across low band slot elements 76L in conductive support plate 48 (e.g., as shown in FIG. 7).

Figure 10:
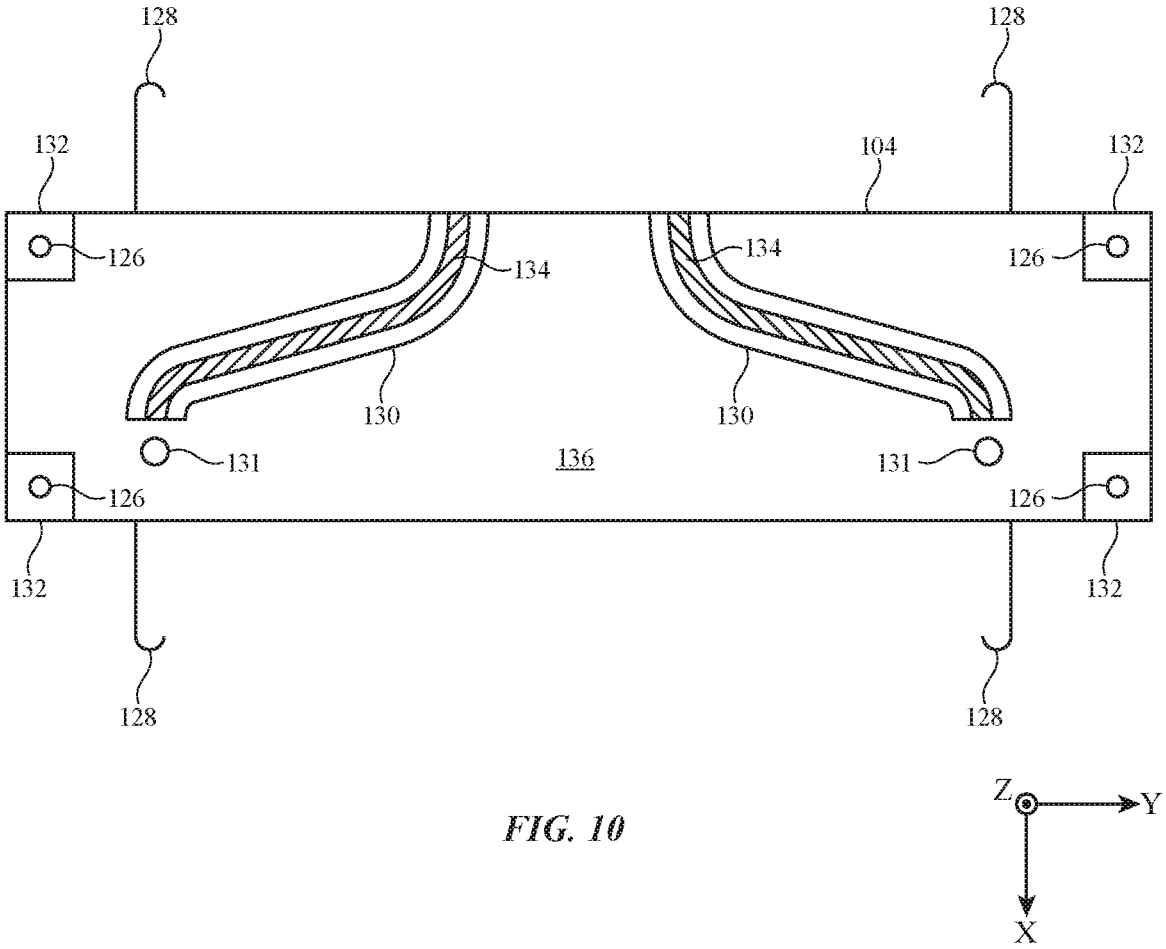
FIG. 10 is a top-down view of an illustrative printed circuit board that may be used to feed a slot antenna of the type shown in FIG. 8 in accordance with some embodiments.

FIG. 10 is a top-down view of printed circuit board 104. As shown in FIG. 10, printed circuit board 104 may have a lateral surface 136 that opposes surface 114 of FIG. 9. Surface 136 may face central portion 90 of conductive support plate 48 (FIG. 8). Conductive ground traces 130 may be patterned on surface 136. Conductive ground traces 130 may overlap conductive ground traces 112 of FIG. 9. Conductive ground traces 130 may be shorted to conductive ground traces 112 by one or more conductive through vias extending through printed circuit board 104. Conductive gaskets 134 may be soldered to conductive ground traces 130. Conductive gaskets 134 may be pressed against the conductive support plate to help maintain a reliable electrical connection between the conductive ground traces and the conductive support plate. Conductive gaskets 134 may serve to ground conductive ground traces 130 and thus conductive ground traces 112 and ground conductor 118 for each coaxial cable 106 (FIG. 9) to the conductive support plate along their lengths.

As shown in FIG. 10, printed circuit board 104 may include through vias 131. Through vias 131 may be aligned with the openings in contact pads 122 of FIG. 9. Through vias 131 may each receive a conductive screw for coupling to the positive antenna feed terminals on the conductive support plate. Conductive ground traces 132 may also be formed on surface 136 in alignment with openings 126.

The example of FIGS. 9 and 10 is merely illustrative. If desired, additional tuning components such as additional tuning capacitors may be coupled across each low band slot. Printed circuit board 104 may have other shapes. Conductive springs 128 may be replaced with any desired conductive interconnect structures (e.g., conductive screws, conductive pins, conductive clips, conductive brackets, solder, welds, conductive adhesive, combinations of these, etc.).

Each antenna 40 in conductive support plate 48 may be fed using a corresponding positive antenna feed terminal 34 and ground antenna feed terminal 36. In the example of FIGS. 7-10, each antenna 40 includes two low band slot elements 76L and a high band slot element 76H that are each fed using a single antenna feed coupled across the high band slot element. This is merely illustrative and, in another suitable arrangement, conductive support plate 48 may include different antennas for handling the first and second frequency bands.

Figure 11:
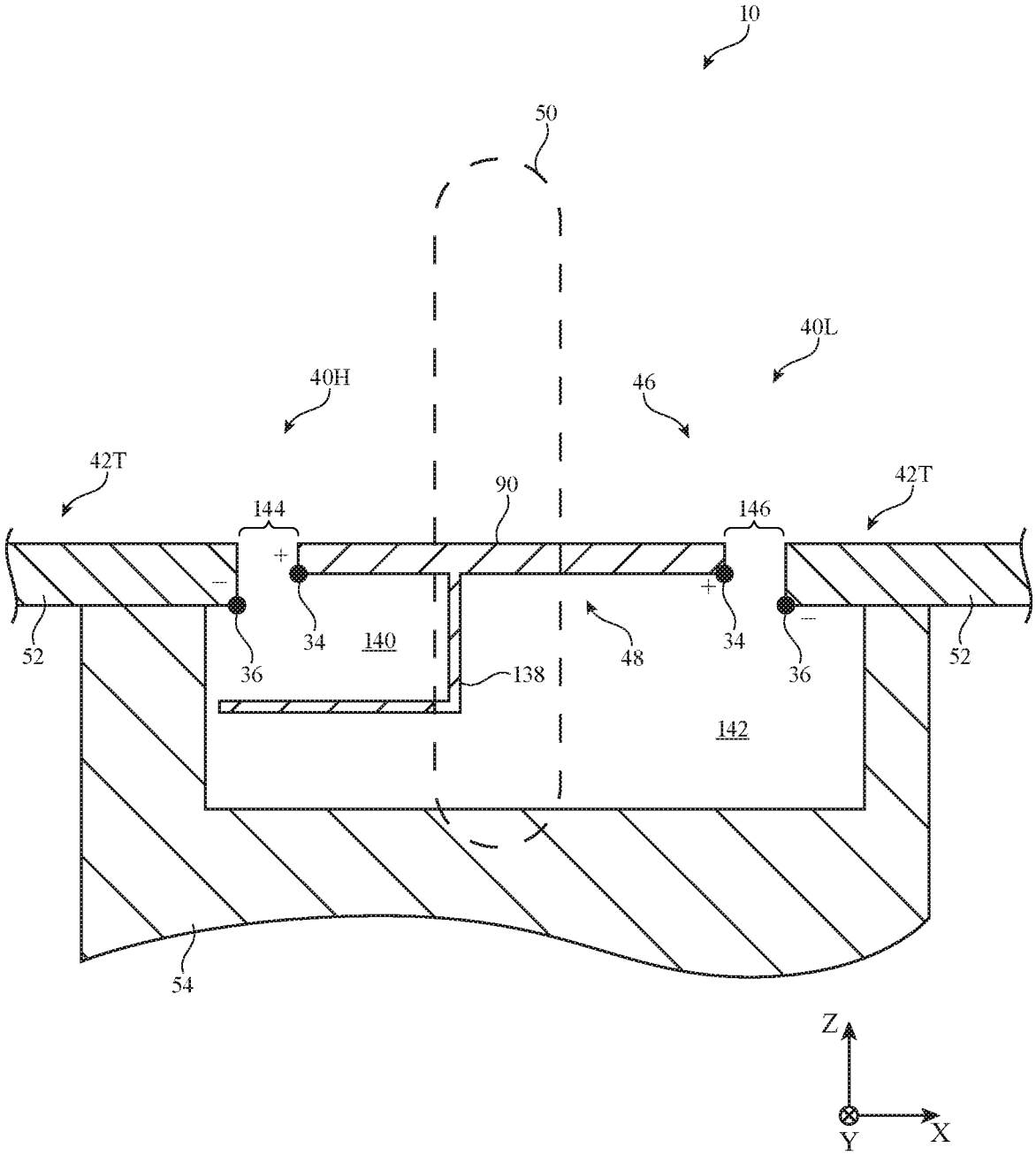
FIG. 11 is a cross-sectional side view of an illustrative conductive support plate having multiple slot antennas for covering different frequencies in accordance with some embodiments.

FIG. 11 is a cross-sectional side view showing how conductive support plate 48 may include a first antenna 40L for handling the first frequency band and a second antenna 40H for handling the second frequency band. As shown in FIG. 11, conductive support plate 48 may be aligned with opening 46 in conductive outer sleeve 52. Central portion 90 may be separated from top wall 42T of conductive outer sleeve 52 by a first slot element 144 and a second slot element 146. Slot elements 144 and 146 may be filled with a dielectric gasket, plastic, or other dielectric materials if desired. Conductive support plate 48 may also include a conductive structure such as conductive structure 138 that divides the space between conductive support plate 48 and inner conductive frame 54 into a first cavity 142 and a second cavity 140. Cavity 142 may be larger than cavity 140.

Slot element 144 may form the resonating element (e.g., slot element 76 of FIGS. 5 and 6) for antenna 40H. Slot element 144 may be fed by a positive antenna feed terminal 34 and a ground antenna feed terminal 36 coupled across slot element 144. Slot element 146 may form the resonating element for antenna 40L. Slot element 146 may be fed by a positive antenna feed terminal 34 and a ground antenna feed terminal 36 coupled across slot element 146. Slot element 146 and cavity 142 may radiate in the first frequency band. Slot element 144 and cavity 140 may radiate in the second frequency band. Conductive support plate 48 may include two or more antennas 40H and two or more antennas 40L (e.g., two slot elements 144 and two slot elements 146 each fed by a respective antenna feed and transmission line) to perform communications using a MIMO scheme. The antenna arrangement of FIG. 11 may, for example, require more space within device 10 to form each of the transmission lines for feeding each slot element 144 and each slot element 146 than in scenarios where a single antenna feed is used to feed both high and low band slots (e.g., as shown in FIGS. 7-10).

Figure 12:
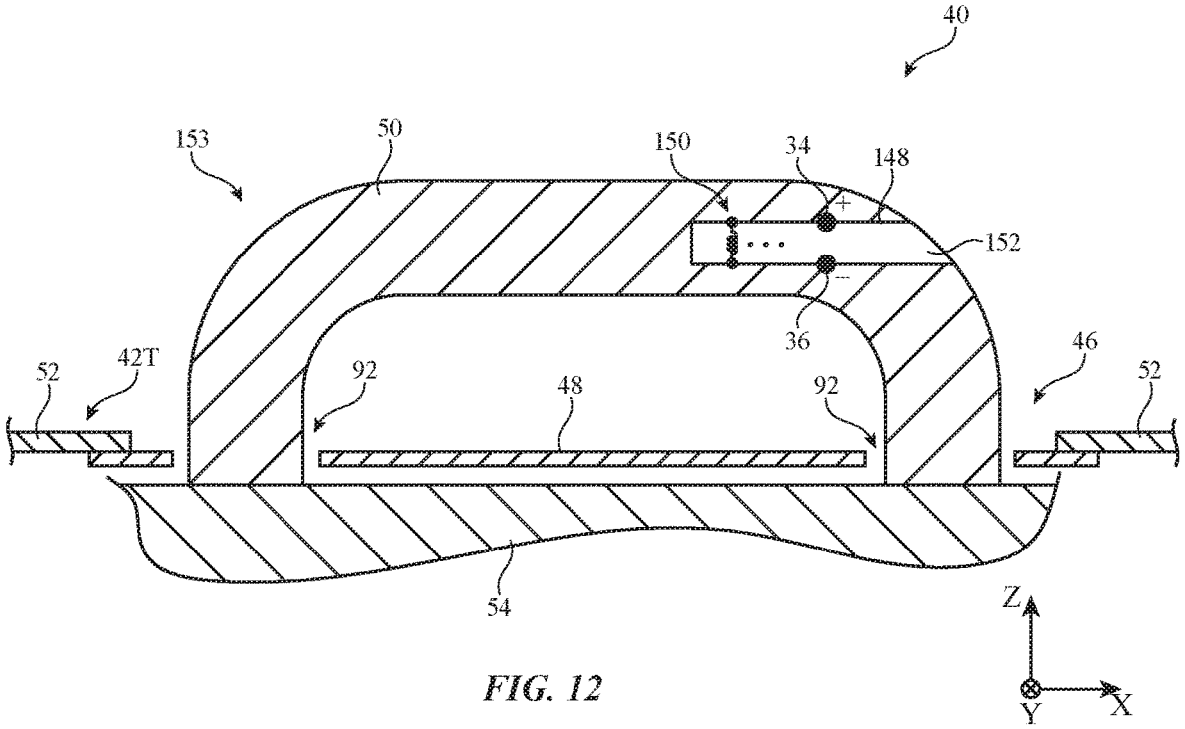
FIG. 12 is a side view of an illustrative slot antenna formed in a solid electronic device handle in accordance with some embodiments.

If desired, portions of electronic device handle 50 may be used to form antennas 40. In general, electronic device handle 50 may be formed from conductive material such as metal. The conductive material may be solid or may be hollow. FIG. 12 is a cross-sectional side view showing how electronic device handle 50 may be used to form antenna 40 in a scenario where the electronic device handle is formed solid conductive material.

As shown in FIG. 12, electronic device handle 50 may be attached to conductive inner frame 54 through openings 92 in conductive support plate 48. Electronic device handle 50 may protrude through opening 46 in top wall 42T of conductive outer sleeve 52. A slot element such as slot element 148 may be formed in electronic device handle 50. Slot element 148 may form the resonating element for antenna 40 (e.g., an open slot such as slot element 76 of FIG. 6). Slot element 148 may be filled with dielectric material 152. Dielectric material 152 may include plastic, ceramic, glass, polymer, or other dielectric materials. Dielectric material 152 may have an external edge that lies flush with the external surfaces of electronic device handle 50.

The antenna feed may be coupled across slot element 148. For example, positive antenna feed terminal 34 may be coupled to electronic device handle 50 at a first side of slot element 148 whereas ground antenna feed terminal 36 is coupled to electronic device handle 50 at a second side of slot element 148. If desired, one or more antenna tuning components (e.g., components 84 of FIG. 6) such as inductor 150 may be coupled across slot element 148. The length of slot element 148 (e.g., length 82 of FIG. 6) and inductor (s) 150 may be selected to provide antenna 40 with desired radiating frequencies. The fundamental mode and/or harmonic mode(s) of slot element 148 may be used to cover both the first frequency band (e.g., at 2.4 GHz) and the second frequency band (e.g., at 5.0 GHz). While the example of FIG. 13 only shows a single antenna 40 in electronic device handle 50, electronic device handle 50 may also include a second antenna 40 formed from an additional slot element at end 153 of electronic device handle 50.

Figure 13:
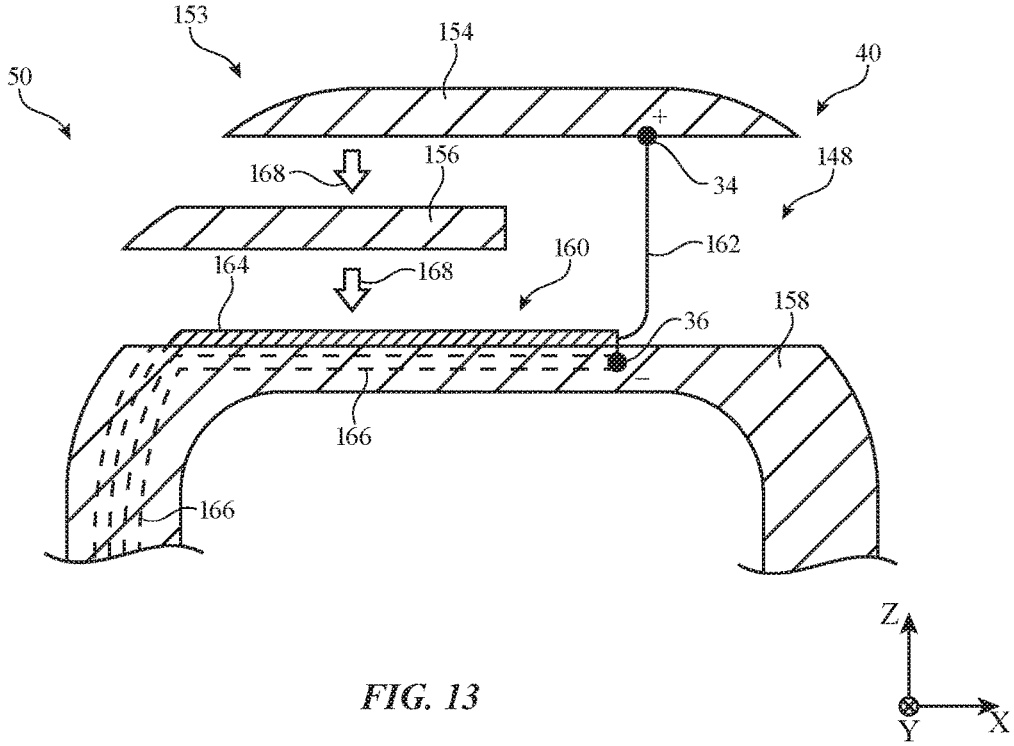
FIG. 13 is an exploded side view of an illustrative solid electronic device handle having a slot antenna in accordance with some embodiments.

Positive antenna feed terminal 34 and ground antenna feed terminal 36 may be coupled to a transmission line located (e.g., embedded) within electronic device handle 50. FIG. 13 is an exploded side view showing how slot element 148 may be fed within electronic device handle 50. As shown in FIG. 13, electronic device handle 50 may include base portion 158, central portion 156, and top portion 154. Base portion 158, central portion 156, and top portion 154 may each be formed using solid pieces of metal. Inductor 150 and dielectric material 152 of FIG. 12 are omitted from FIG. 13 for the sake of clarity.

Base portion 158 may be coupled to the conductive internal frame. A channel such as channel 166 may be formed in base portion 158. Antenna 40 may be fed using transmission line 160. Transmission line 160 may be located within channel 166. Transmission line 160 may extend through base portion 158 to the interior of device 10 (e.g., to radio-frequency transceiver circuitry 24 of FIG. 1). Transmission line 160 may be a coaxial cable having an inner signal conductor 162 coupled to positive antenna feed terminal 34 and an outer ground conductor 164 coupled to ground antenna feed terminal 36. Ground conductor 164 may also be soldered to base portion 158 along some or all of its length.

During assembly, central portion 156 may be mounted to base portion 158 and top portion 154 may be mounted to central portion 156 of electronic device handle 50, as shown by arrows 168 (e.g., to form a fully assembled electronic device handle 50 as shown in FIG. 12). Central portion 156 may be secured to base portion 158 using welds, solder, conductive adhesive, and/or any other desired conductive interconnect structures. Similarly, top portion 154 may be secured to central portion 156 using welds, solder, conductive adhesive, and/or any other desired conductive interconnect structures. In another suitable arrangement, central portion 156 and top portion 154 may be formed from a single integral piece of metal. In this way, antenna 40 may be integrated within a solid metal electronic device handle 50 (e.g., external to the conductive outer sleeve) while also hiding the transmission line for antenna 40 from view and protecting the transmission line from damage. While FIG. 13 illustrates a single antenna for the sake of clarity, an additional antenna may be formed using similar structures at end 153 of electronic device handle 50. If desired, a thin dielectric layer or coating may be provided over electronic device handle 50 and slot element 148 to protect electronic device handle 50 from damage and to prevent contaminants from entering slot element 148. Dielectric material 152 may be omitted if desired.

Figure 14:
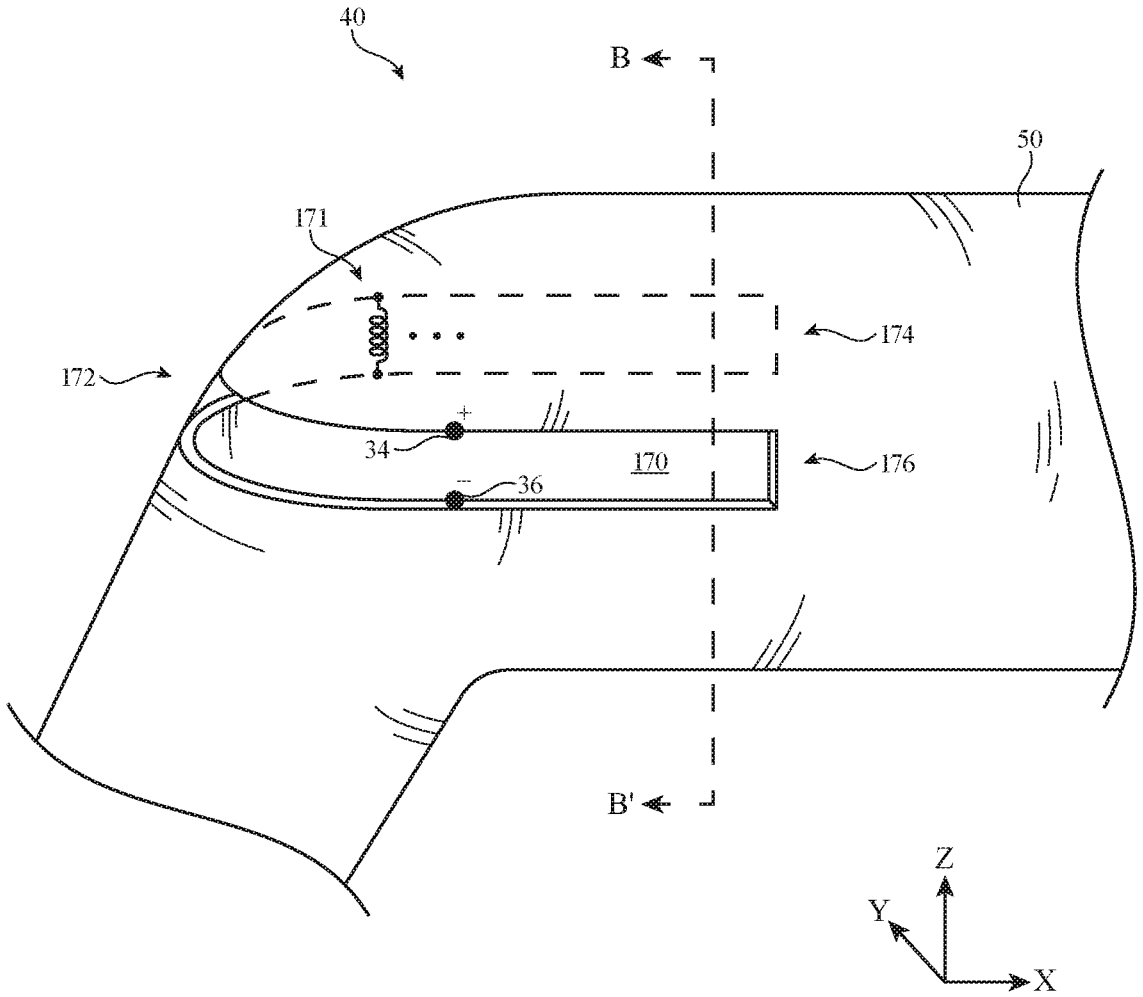
FIG. 14 is a perspective view of an illustrative slot antenna formed in a hollow electronic device handle in accordance with some embodiments.

FIG. 14 is a perspective view showing how electronic device handle 50 may be used to form antenna 40 in a scenario where the electronic device handle is formed from hollow conductive material. As shown in FIG. 14, electronic device handle 50 may be formed from conductive material such as metal that surrounds an interior cavity 170. Interior cavity 170 may be filled with air, plastic, and/or other dielectric materials.

A slot element such as slot element 172 may be formed in electronic device handle 50 (e.g., in the conductive material of electronic device handle 50 separating interior cavity 170 from the exterior of the electronic device handle). Slot element 172 may extend from edge (end) 174 to edge (end) 176. Slot element 172 may form the resonating element for antenna 40 (e.g., slot element 172 may be a closed slot element such as slot element 76 of FIG. 5). Slot element 172 may be filled with dielectric material if desired (e.g., a dielectric window that separates interior cavity 170 from the exterior of electronic device handle 50).

The antenna feed for antenna 40 may be coupled across slot element 172. For example, positive antenna feed terminal 34 may be coupled to electronic device handle 50 at a first side of slot element 172 whereas ground antenna feed terminal 36 is coupled to electronic device handle 50 at a second side of slot element 172. If desired, one or more antenna tuning components (e.g., tuning components 84 of FIG. 5) such as inductor 171 may be coupled across slot element 172. The length of slot element 172 (e.g., length 82 of FIG. 5 or the length as measured from edge 174 to edge 176 of FIG. 14) and inductor(s) 171 may be selected to configure antenna 40 to radiate in desired frequency bands. The fundamental mode and/or harmonic mode(s) of slot element 172 may configure antenna 40 to radiate in both the first frequency band (e.g., at 2.4 GHz) and the second frequency band (e.g., at 5.0 GHz). While the example of FIG. 14 only shows a single antenna 40 in electronic device handle 50, electronic device handle 50 may include a second antenna 40 formed from an additional slot element at an opposing end of the electronic device handle.

Figure 15:
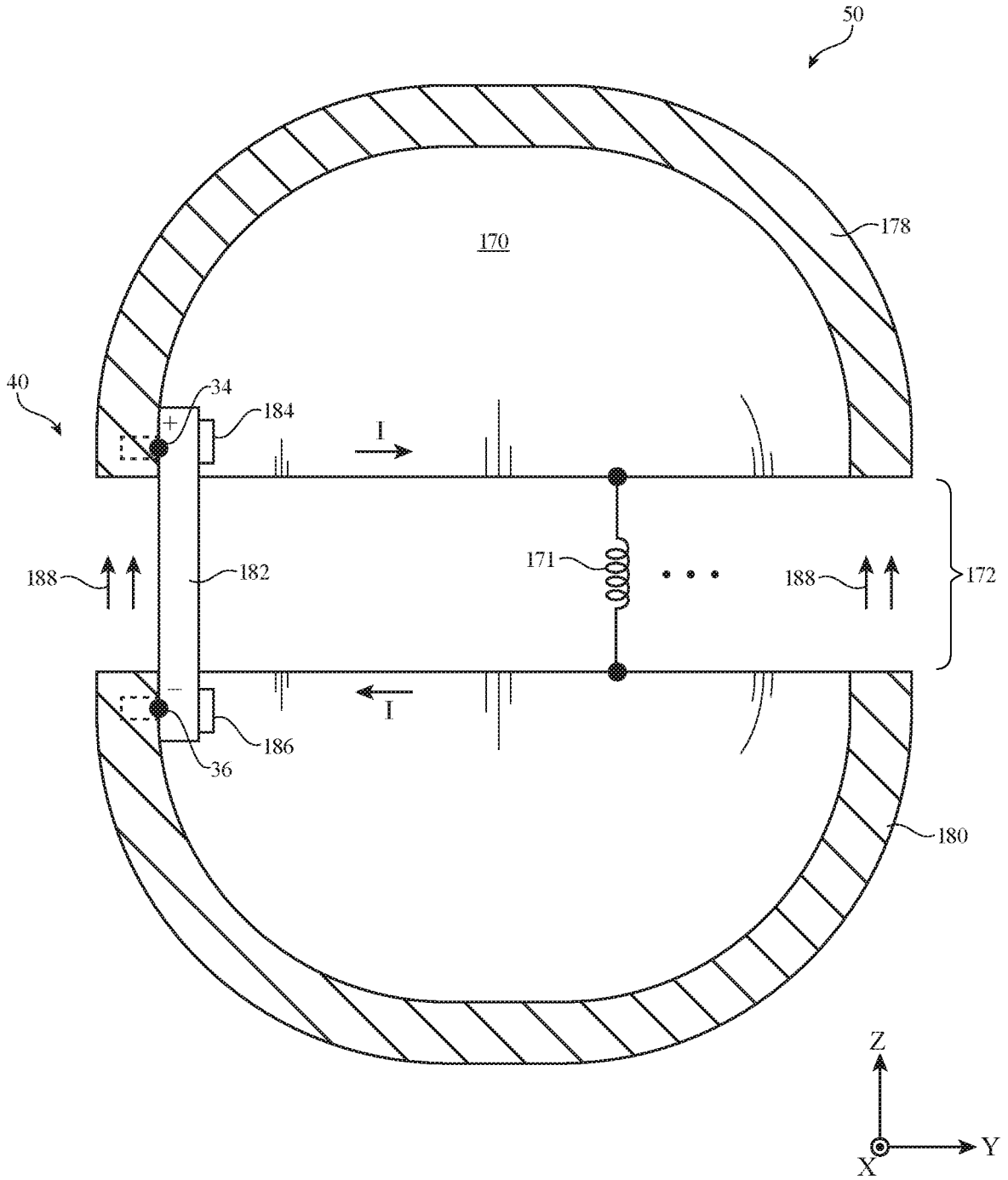
FIG. 15 is a cross-sectional side view of an illustrative hollow electronic device handle having a slot antenna in accordance with some embodiments.

Positive antenna feed terminal 34 and ground antenna feed terminal 36 may be coupled to a transmission line located within interior cavity 170. FIG. 15 is a cross-sectional side view showing how slot element 172 may be fed using a transmission line within electronic device handle 50 (e.g., as viewed in the direction of line BB' of FIG. 14). As shown in FIG. 15, electronic device handle 50 may include a first conductive structure 178 and a second conductive structure 180 defining opposing sides of slot 172. The lateral surfaces of conductive structures 178 and 180 define the edges of interior cavity 170. While conductive structure 178 is shown separately from conductive structure 180 in FIG. 15, conductive structures 178 and 180 may be formed from different portions of the same integral conductive structure used to form electronic device handle 50 (e.g., conductive structures 178 and 180 may be joined together at edges 176 and 174 of slot element 172 as shown in FIG. 14).

A printed circuit board such as printed circuit board 182 may be mounted within interior cavity 170. Printed circuit board 182 may be secured (fastened) to the interior surface of conductive structure 178 using conductive screw 184 and may be secured to the interior surface of conductive structure 180 using conductive screw 186. Conductive screw 184 be received by a threaded screw hole in conductive structure 178. Conductive screw 186 may be received by a threaded screw hole in conductive structure 180. Printed circuit board 182 may extend along the interior surface of conductive structures 178 and 180.

The transmission line for antenna 40 (not shown in FIG. 15 for the sake of clarity) may be coupled to printed circuit board 182. The transmission line may include a signal conductor coupled to signal traces on printed circuit board 182 and a ground conductor coupled to ground traces on printed circuit board 182. The ground conductor and ground traces may be coupled to conductive structure 180 at ground antenna feed terminal 36 using conductive screw 186. The signal conductor and signal traces on printed circuit board 182 may be coupled to conductive structure 178 at positive antenna feed terminal 34 using conductive screw 184. Conductive screws 186 and 184 may be screwed in place using a screw driver or drill bit extending through slot element 172.

Antenna currents I may flow along the edges of slot element 172 between positive antenna feed terminal 34 and ground antenna feed terminal 36. A corresponding electric field 188 may be produced within slot element 172. The electric field vectors of electric field 188 may point parallel to the Z-axis of FIG. 15 (e.g., slot element 172 may function as a closed slot antenna resonating element despite being located at the edge of electronic device handle 50).

If desired, printed circuit board 182 may extend along the entire length of slot element 172. In this scenario, inductors 171 may also be mounted to printed circuit board 182 and conductive screws may be used to couple the inductors to conductive structures 178 and 180. In another suitable arrangement, additional printed circuit boards may be formed within interior cavity for supporting inductors 171. Inductors 171 may be coupled between conductive structures 178 and 180 without printed circuit boards if desired. Inductors 171 may be replaced with any desired antenna tuning components (e.g., capacitors, resistors, and/or inductors arranged in any desired manner).

The example of FIG. 15 is merely illustrative. Slot element 172 may be provided with other shapes (e.g., shapes having any desired number of curved and/or straight edges). The transmission line may be coupled to positive antenna feed terminal 34 and ground antenna feed terminal 36 without an intervening printed circuit board if desired. If desired, a thin dielectric layer or coating may be provided over conductive structures 178 and 180 and over slot element 172 to protect electronic device handle 50 from damage and to prevent contaminants from entering interior cavity 170.

Figure 16:
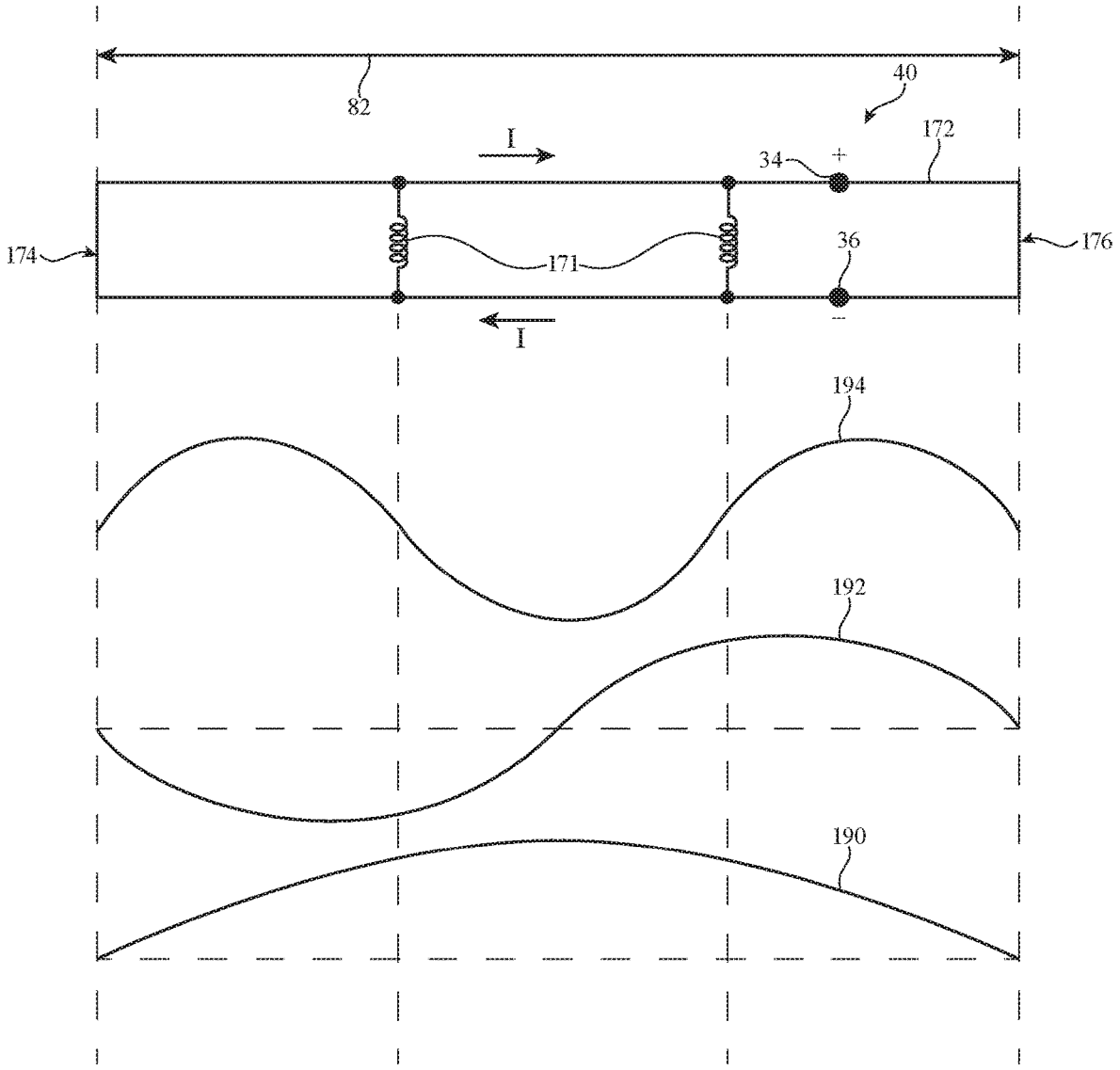
FIG. 16 is a schematic diagram that illustrates how an illustrative slot antenna of the type shown in FIGS. 14 and 15 may support multiple resonant modes in accordance with some embodiments.

FIG. 16 is a schematic diagram showing how slot element 172 of FIGS. 14 and 15 may be configured to cover multiple frequency bands. Slot element 172 of FIG. 16 has been flattened into a single plane for the sake of clarity. As shown in FIG. 16, slot element 172 has length 82 extending between edges 174 and 176. Positive antenna feed terminal 34 and ground antenna feed terminal 36 are coupled across slot element 172 at a distance from edge 176 that is selected to match the impedance of antenna 40 to the impedance of the transmission line coupled to antenna 40.

Slot element 172 may be characterized by multiple electromagnetic standing wave modes that are associated with different response peaks for antenna 40. These discrete modes may be determined by the dimensions of slot element 172 (e.g., length 82). For example, the dimensions of slot element 172 may define the boundary conditions for electromagnetic standing waves in each of the standing wave modes that are excited on slot element 172 by antenna currents I conveyed over positive antenna feed terminal 34 and ground antenna feed terminal 36 and/or by received radio-frequency signals. Such standing wave modes of slot element 172 include a fundamental mode and one or more harmonics of the fundamental mode (i.e., so-called harmonic modes of slot element 172). Slot element 172 may exhibit antenna response peaks at frequencies associated with the fundamental mode and one or more of the harmonic modes of slot element 172 (e.g., where the harmonic modes are typically at multiples of the fundamental modes).

Curves 190, 192, and 194 are shown on FIG. 16 to illustrate some of the standing wave modes of slot element 172. As shown in FIG. 16, curves 190, 192, and 194 plot the voltage across slot element 172 (perpendicular to length 82) at different points along length 82. Similarly, curves 190, 192, and 194 may also represent the magnitude of the electric field within slot element 172 at different points along length 82 (e.g., where the electric field extends in a direction perpendicular to length 82, as shown by electric field 188 of FIG. 15). In each mode, nodes in the voltage distribution are present at edges 174 and 176 (e.g., length 82 establishes boundary conditions for the electromagnetic standing waves produced on slot element 172 in the different modes).

Curve 190 represents the voltage distribution across slot element 172 in the fundamental mode. As shown in FIG. 16, in the fundamental mode associated with curve 190, the voltage across slot element 172 (e.g., in a direction parallel to edges 174 and 176) and the magnitude of the electric field reaches a maximum (e.g., an anti-node) at the center of slot element 172 (e.g., half way across length 82). Length 82 may establish the fundamental mode, where length 82 is approximately one-half of the corresponding wavelength of operation. The wavelength of operation may, for example, be an effective wavelength of operation based on the dielectric material within slot element 172.

Curve 192 represents the voltage distribution across slot element 172 in a first harmonic mode. As shown in FIG. 16, in the first harmonic mode associated with curve 192, the voltage across slot element 172 and the magnitude of electric field reach maxima (anti-nodes) at one-quarter and three-quarters of length 82 from edge 174. At the same time, in the first harmonic mode the voltage across slot element 172 and the magnitude of the electric field are at a node (e.g., a minimum or zero-value) at the center of slot element 172. Antenna 40 may exhibit a response peak associated with the first harmonic mode at a frequency that is approximately twice the frequency associated with the fundamental mode, for example.

Curve 194 represents the voltage distribution across slot element 172 in a second harmonic mode. As shown in FIG. 16, in the second harmonic mode associated with curve 194, the voltage across slot element 172 and the magnitude of the electric field reach maxima (anti-nodes) at one-sixth, one-half, and five sixths of length 82 from edge 174. At the same time, the voltage across slot element 172 and the magnitude of the electric field form nodes at one-third and two-thirds of length 82 from edge 174. While the example of FIG. 16 only shows three standing wave modes, higher order harmonics may be present on slot element 172 in practice.

The modes associated with curves 190, 192, and/or 194 may support coverage in corresponding frequency bands for antenna 40. In one suitable arrangement, the fundamental mode associated with curve 190 may configure slot element 172 to cover the first frequency band (e.g., at 2.4 GHz). Similarly, the harmonic mode associated with curve 192 may configure slot element 172 to cover some of the second frequency band (e.g., at 5 GHz). If care is not taken, slot element 172 may not exhibit sufficient bandwidth to cover all of the second frequency band (e.g., to cover frequencies from 5 GHz to 6 GHz with an antenna efficiency that exceeds a minimum threshold efficiency). The harmonic mode associated with curve 194 may configure slot element 172 to cover higher frequencies such as frequencies at the upper end of the second frequency band (e.g., to cover a frequency band centered at 5.8 GHz such that the harmonic modes associated with curves 192 and 194 collectively cover the entire range of frequencies from 5 GHz to 6 GHz with a satisfactory antenna efficiency).

Inductors 171 may tweak the frequencies covered by the fundamental mode associated with curve 190 and the harmonic mode associated with curve 192 (e.g., to cover a frequency band at 2.4 GHz and a frequency band at 5.1 GHz) without affecting the frequencies covered by the harmonic mode associated with curve 194. For example, inductors 171 may be coupled across slot element 172 at locations along length 82 that correspond to the nodes of curve 194 (e.g., at locations where the harmonic mode associated with curve 194 exhibits electric field and voltage magnitude minima). However, at the same time, inductors 171 are coupled across slot elements 172 at locations where curves 192 and 190 do not exhibit nodes. Placing inductors 171 across slot element in this way may allow inductors 171 to tweak the frequency response associated with curves 190 and 192 without impacting the frequency response associated with curve 194.

The example of FIG. 16 is merely illustrative. In general, any desired number of any desired type of antenna tuning components may be coupled across slot element 172 at any desired locations. Similar fundamental and harmonic modes may also be used to configure slot element 148 of FIGS. 12 and 13 to cover multiple frequency bands. Electronic device 10 may be provided with antennas 40 in conductive support plate 48 (e.g., as shown in FIGS. 7 and 8), antennas formed within solid electronic device handles 50 (e.g., as shown in FIGS. 12 and 13), and/or antennas formed within hollow electronic device handles 50 (e.g., as shown in FIGS. 14-16). The locations of positive antenna feed terminal 34 and ground antenna feed terminal 36 in FIGS. 7, 8, and 11-15 may be swapped if desired. The antennas in device 10 may exhibit satisfactory antenna efficiency despite the presence of the conductive outer sleeve.

The foregoing is merely illustrative and various modifications can be made to the described embodiments. The foregoing embodiments may be implemented individually or in any combination.

What is claimed is:

1. An electronic device, comprising:

a conductive plate having an opening;

an electronic device handle extending through the opening in the conductive plate; and an antenna having first and second slot elements in the conductive plate and an antenna feed coupled to the conductive plate across the first slot element, wherein the first slot element is formed in a central portion of the conductive plate, and a lip portion of the conductive plate that extends around a periphery of the central portion defines an edge of the second slot element.

2. The electronic device defined in claim 1, wherein the second slot element is configured to radiate in a first frequency band, the first slot element is configured to radiate in a second frequency band that is higher than the first frequency band, and the first slot element is configured to indirectly feed the second slot element.

3. The electronic device defined in claim 1, wherein the central portion is in a first plane and the lip portion is in a second plane.

4. The electronic device defined in claim 3, further comprising:

a conductive inner frame, wherein the conductive plate is mounted to the conductive inner frame; and a conductive outer sleeve having an additional opening, wherein the conductive outer sleeve is mounted over the conductive inner frame, the central portion of the conductive plate lies within the additional opening, the electronic device handle is coupled to the conductive inner frame, and the electronic device handle protrudes through the additional opening.

5. The electronic device defined in claim 4, further comprising:

a dielectric gasket interposed between the central portion of the conductive plate and the conductive outer sleeve, wherein the second slot element is configured to convey radio-frequency signals in a first frequency band through the dielectric gasket and the first slot element is configured to convey radio-frequency signals in a second frequency band.

6. The electronic device defined in claim 5, wherein the first frequency band comprises a 2.4 GHz wireless local area network frequency band and the second frequency band comprises a 5 GHz wireless local area network frequency band.

7. The electronic device defined in claim 4, further comprising an air vent in the conductive outer sleeve.

8. The electronic device defined in claim 1, further comprising:

a tuning element coupled to the conductive plate across the second slot element.

9. The electronic device defined in claim 1, further comprising:

a printed circuit board having opposing first and second surfaces;

first ground traces on the first surface;

a contact pad on the first surface;

a coaxial cable having a ground conductor coupled to the first ground traces and having a signal conductor coupled to the contact pad;

second ground traces on the second surface and coupled to the first ground traces by a conductive via extending through the printed circuit board; and a conductive gasket coupled to the second ground traces and pressed against the conductive plate.

10. The electronic device defined in claim 9, further comprising:

a conductive screw that extends through the printed circuit board and that couples the contact pad to the conductive plate.

11. The electronic device defined in claim 10, further comprising:

a capacitor on the printed circuit board;

an additional conductive screw that extends through the printed circuit board and that couples a first terminal of the capacitor to the conductive plate; and a conductive spring that couples a second terminal of the capacitor to the conductive plate.

12. The electronic device defined in claim 1, further comprising:

an additional antenna having a third slot element in the conductive plate and an additional antenna feed coupled to the conductive plate across the third slot element.

13. The electronic device defined in claim 1, further comprising:

a conductive inner frame;

control circuitry within the conductive inner frame;

a conductive outer sleeve that covers the conductive inner frame; and a first opening in the conductive outer sleeve, wherein the conductive plate is mounted to the conductive inner frame and aligned with the first opening, the electronic device handle is coupled to the conductive inner frame, and the electronic device handle protrudes through the first opening in the conductive outer sleeve and through the opening in the conductive plate.

14. The electronic device defined in claim 13, further comprising:

a second opening in the conductive outer sleeve;

an additional conductive plate, wherein the additional conductive plate is mounted to the conductive inner frame and aligned with the second opening;

an additional electronic device handle extending through an additional opening in the additional conductive plate; and an additional antenna having an additional slot element in the additional conductive plate and an additional antenna feed coupled to the additional conductive plate across the additional slot element.

15. The electronic device defined in claim 13, wherein the conductive outer sleeve has a first wall that includes the first opening and a second wall extending perpendicular to the first wall, the electronic device further comprising an air vent selected from the group consisting of: a first air vent in the first wall and a second air vent in the second wall.

16. The electronic device defined in claim 13, wherein the conductive inner frame and the conductive plate define edges of a dielectric-filled cavity that backs the first slot element.

17. An electronic device, comprising:

a conductive plate having an opening;

an electronic device handle extending through the opening in the conductive plate;

an antenna having a slot element in the conductive plate and an antenna feed coupled to the conductive plate across the slot element;

a printed circuit substrate having opposing first and second surfaces;

a transmission line having a ground conductor coupled to a first ground trace at the first surface and having a signal conductor coupled to the printed circuit substrate; and a conductive structure that couples a second ground trace at the second surface to the conductive plate, wherein a conductive via in the printed circuit substrate connects the first ground trace to the second ground trace.

18. An electronic device, comprising:

a conductive plate having an opening;

an electronic device handle extending through the opening in the conductive plate;

an antenna having a slot element in the conductive plate and an antenna feed coupled to the conductive plate across the slot element;

a conductive inner frame;

control circuitry within the conductive inner frame; and a conductive outer sleeve that covers the conductive inner frame and that has an additional opening, wherein the conductive plate is mounted to the conductive inner frame and aligned with the additional opening, and the electronic device handle protrudes through the additional opening in the conductive outer sleeve.

* * * * *